US008985740B2

(12) United States Patent
Ibe et al.

(10) Patent No.: US 8,985,740 B2
(45) Date of Patent: Mar. 24, 2015

(54) INKJET PRINTING APPARATUS AND CONTROL METHOD

(71) Applicant: Canon Kabushiki Kaisha, Tokyo (JP)

(72) Inventors: Tsuyoshi Ibe, Yokohama (JP); Masaya Uetsuki, Yokohama (JP); Kazuo Suzuki, Yokohama (JP); Toshimitsu Danzuka, Tokyo (JP); Masataka Kato, Yokohama (JP); Asako Tomida, Kawasaki (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/804,552

(22) Filed: Mar. 14, 2013

(65) Prior Publication Data

US 2013/0257980 A1 Oct. 3, 2013

(30) Foreign Application Priority Data

Mar. 28, 2012 (JP) ..... 2012-073289
Dec. 18, 2012 (JP) ..... 2012-275991

(51) Int. Cl.
*B41J 2/165* (2006.01)

(52) U.S. Cl.
CPC ..... *B41J 2/1652* (2013.01); *B41J 2/16526* (2013.01); *B41J 2/16535* (2013.01); *B41J 2002/1655* (2013.01)
USPC ..... 347/35

(58) Field of Classification Search
CPC ..... B41J 2/16535; B41J 2/165; B41J 2/1655
USPC ..... 347/35
See application file for complete search history.

(56) References Cited

U.S. PATENT DOCUMENTS 4,947,190 A * 8/1990 Mizusawa et al. ..... 347/33
6,033,051 A * 3/2000 Kaneko ..... 347/23
6,481,905 B2 * 11/2002 Day et al. ..... 400/88
6,595,611 B1 * 7/2003 Ruffino ..... 347/5

FOREIGN PATENT DOCUMENTS

JP 2003-300329 A 10/2003
JP 2003300329 A * 10/2003

* cited by examiner

*Primary Examiner* — Alessandro Amari
*Assistant Examiner* — Michael Konczal
(74) *Attorney, Agent, or Firm* — Canon USA Inc. IP Division

(57) ABSTRACT

An inkjet printing apparatus includes a purge unit having a sheet member that purges ink deposited on an orifice face of a print head and a winding unit that winds the sheet member. By using the number of ink ejections executed between a first purge operation and a second purge operation, the amount of winding of the sheet member is controlled after the second purge operation is completed.

12 Claims, 20 Drawing Sheets

| NOZZLE NUMBER | 1 | 2 | 3 | 4 | 5 | 6 | 7 | 8 | … | 25 | 26 | 27 | 28 | 29 | 30 | 31 | 32 | 33 | 34 | 35 | 36 | 37 | 38 | 39 | 40 | … |
|---|---|---|---|---|---|---|---|---|---|---|---|---|---|---|---|---|---|---|---|---|---|---|---|---|---|---|
| ORDER OF DRIVING | 1 | 2 | 3 | 4 | 5 | 6 | 7 | 8 | … | 25 | 26 | 27 | 28 | 29 | 30 | 31 | 32 | 1 | 2 | 3 | 4 | 5 | 6 | 7 | 8 | … |

| NOZZLE NUMBER | 1 | 2 | 3 | 4 | 5 | 6 | 7 | 8 | … | 25 | 26 | 27 | 28 | 29 | 30 | 31 | 32 | 33 | 34 | 35 | 36 | 37 | 38 | 39 | 40 | … |
|---|---|---|---|---|---|---|---|---|---|---|---|---|---|---|---|---|---|---|---|---|---|---|---|---|---|---|
| ORDER OF DRIVING | 17 | 1 | 18 | 2 | 19 | 3 | 20 | 4 | … | 29 | 13 | 30 | 14 | 31 | 15 | 32 | 16 | 17 | 1 | 18 | 2 | 19 | 3 | 20 | 4 | … |

INKJET PRINTING APPARATUS AND CONTROL METHOD

BACKGROUND OF THE INVENTION

1. Field of the Invention

The present invention relates to an inkjet printing apparatus and a method for controlling an inkjet printing apparatus.

2. Description of the Related Art

In inkjet printing apparatuses, ink is sometimes deposited to the surface of a print head (hereinafter also referred to as an "orifice face") having nozzles (ejection ports) formed therein and, therefore, normal ejection is interfered. In printing apparatuses that form an image using a plurality of types of ink that react to one another or in printing apparatuses that forms an image using reaction liquid and ink, the ink may be firmly deposited onto an orifice face, and it may be difficult to remove the deposited ink. In addition, in printing apparatuses that solidifies ink using an ultraviolet ray, a microwave, or heat in order to improve the fastness of the ink, the same issue arises. To address such an issue, a solvent inkjet printer or a UV-curable inkjet printer is sometimes used. In some cases, such a printer requires a maintenance operation performed by a user.

Examples of the maintenance method include (1) wiping away ink by sliding a wiper or a blade on an ejection surface and (2) absorbing ink by urging a porous sheet-like purge member having ink absorbency against an ejection surface. The sheet-like purge member is also referred to as a "web". Hereinafter, the sheet-like purge member is simply referred to as a "sheet member". The above method (2) is described in Japanese Patent Laid-Open No. 2003-300329. In the technology described in Japanese Patent Laid-Open No. 2003-300329, after the purge operation is performed, a predetermined amount of the sheet member is wound and collected.

According to the above-described method (2), accumulated ink and dust particles deposited on the orifice face can be removed. If a recording medium is paper, a paper fiber that generates an undesired ink line on the recording medium can be also removed. According to the above-described method (1), if a wiper is used, wet ink spreads after the ejection surface is wiped. In contrast, if a wiping mechanism is used, wiping of thickening ink generated by heat and evaporation may be difficult. The method (2) can address such issues. Accordingly, the ink ejection performance can be more consistently maintained or recovered.

If the orifice face of the print head is cleaned using the method (2), that is, by using a sheet member, the following issue arises: if the amount of winding is set to a small value, the entire portion of the sheet member used is not collected, in some cases. Accordingly, the portion of the sheet member used for cleaning the orifice face may be reused in the next cleaning operation and, thus, the cleaning effect may be decreased. In contrast, if the amount of winding is set to a large value, the portion of the sheet member used can be more reliably collected. However, it is likely to collect an unused portion. In addition, since the use amount of the sheet member increases, the use efficiency of the sheet member is decreased.

SUMMARY OF THE INVENTION

The present invention provides an inkjet printing apparatus capable of sufficiently purging ink deposited on the orifice face of the print head using a sheet member and limiting a portion of the sheet member used to an optimal amount.

According to an embodiment of the present invention, an inkjet printing apparatus includes a print head having at least one nozzle array disposed in an orifice face, where the nozzle array includes a plurality of nozzles that are arranged in a predetermined direction and that eject ink, a scanning unit configured to cause the print head to scan in a direction perpendicular to the predetermined direction, a purge unit disposed in the vicinity of one end portion of a scanning area of the scanning unit, where the purge unit includes a sheet member configured to purge ink deposited on the orifice face of the print head and a winding unit configured to wind the sheet member thereon, and a control unit configured to control, on the basis of the number of ink ejections from the print head executed between a first purging operation performed by the purge unit and a second purging operation subsequently performed after the first purging operation is performed, an amount of winding of the sheet member wound by the winding unit after the second purging operation is completed.

According to the embodiment, ink deposited on the orifice face of the print head can be sufficiently purged using the sheet member. In addition, the amount of the sheet member used for purging can be set to an optimum amount.

Further features of the present invention will become apparent from the following description of exemplary embodiments with reference to the attached drawings.

DESCRIPTION OF THE EMBODIMENTS

Exemplary embodiments of the present invention are described in detail below with reference to the accompanying drawings. The configuration of an inkjet printing apparatus according to an exemplary embodiment of the present invention and the print operation performed by the inkjet printing apparatus are described first.

(1-1) Configuration of Inkjet Printing Apparatus

Figure 1A:
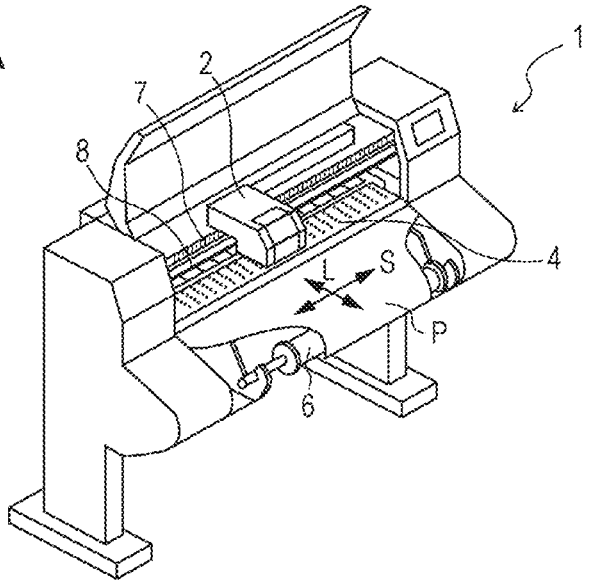
FIGS. 1A to 1C are schematic illustrations of a whole printing apparatus and the internal mechanism of the printing apparatus according to an embodiment of the present invention.
Figure 1B:
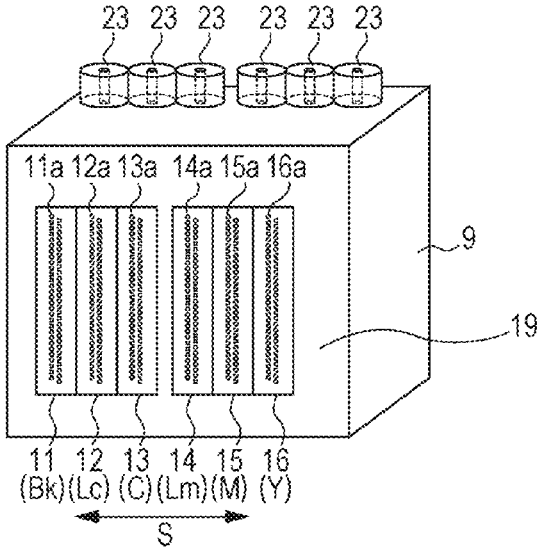
Figure 1C:
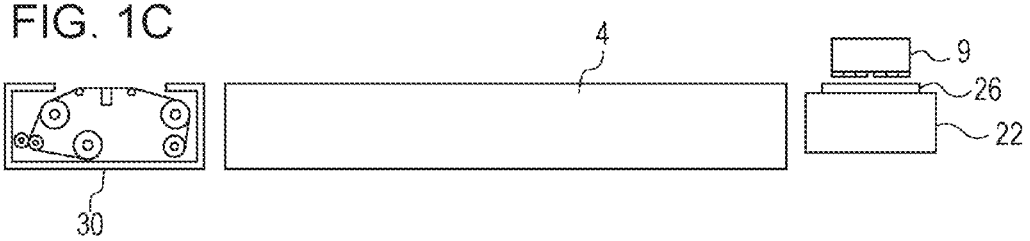

FIG. 1A is a schematic illustration of the inkjet printing apparatus according to the present exemplary embodiment of the present invention. FIG. 1B is a schematic perspective view of a print head 9 mounted in a carriage 2 of the inkjet printing apparatus illustrated in FIG. 1A. FIG. 1C is a schematic illustration of an internal mechanism of FIG. 1A. As illustrated in FIG. 1A, an inkjet printing apparatus 1 is a printer of a serial scan type. The inkjet printing apparatus 1 forms an image by scanning (main scanning) the print head 9 over a recording medium P in a direction (a main scanning direction) orthogonal to a direction in which the recording medium P is conveyed.

The configuration of the inkjet printing apparatus 1 and the print operation performed by the inkjet printing apparatus 1 are briefly described next with reference to FIG. 1A. The recording medium P held by a spool 6 is conveyed onto a platen 4 by a sheet feed roller (not illustrated). The sheet feed roller is driven by a sheet feed motor (not illustrated) via a gear. A carriage motor (not illustrated) moves a carriage unit 2 to scan along a guide shaft 8 extending in a main scanning direction S at a predetermined conveyance position. During the scan, ink is ejected from a nozzle (an ink ejection port) of the print head 9 removably mounted in the carriage unit 2 at a point in time based on a position signal received from an encoder 7. Printing is performed on a certain printing width of the recording medium P that is equal to the nozzle array length. Thereafter, the recording medium P is conveyed, and printing is performed on the next region of the recording medium P having the printing width.

(1-2) Structure of Print Head

As illustrated in FIG. 1B, the print head 9 has chips 11 to 16 that are arrayed up side by side thereon in the main scanning direction S. In addition, the chips 11 to 16 are disposed so as to be parallel to one another. Each of the chips 11 to 16 has a plurality of nozzle arrays that can eject ink of one of a plurality of different hues (colors having different densities). That is, the chips 11 to 16 include nozzle arrays 11*a* to 16*a* each having a plurality of nozzles, respectively. The ink colors are, for example, black (Bk), light cyan (Lc), cyan (C), light magenta (Lm), magenta (M), and yellow (Y). That is, each of the nozzle arrays 11*a* to 16*a* ejects ink having a color assigned thereto among the plurality of colors. Each of the nozzles has an energy generating device (a print element) that generates energy for ejecting ink when power is applied thereto. Examples of the energy generating device include a heating element (a heater) that generates thermal energy when power is applied thereto and a piezoelectric element. When a heating element is used as the energy generating device, a bubble is formed in the ink due to heat generated by the heating element. Thus, a pressure is generated, and the ink is ejected from an ejection port due to the pressure. Each of the nozzle arrays 11*a* to 16*a* receives ink supplied from one of ink introducing units 23 via an ink flow passage formed in the print head 9. Each of the ink introducing units 23 receives ink from an ink tank (described in more detail below) via a tube.

(1-3) Recovery Unit

The carriage unit 2 stops at a home position and a back position before printing begins or during printing as necessary. As illustrated in FIG. 1C, the home position is located within a scanning area of the carriage unit 2 and outside an area where printing is performed on a recording medium. A recovery unit 22 including caps and a wiper is disposed in the vicinity of the home position. In contrast, a purge unit 30 is disposed in the vicinity of the back position.

Figure 2:
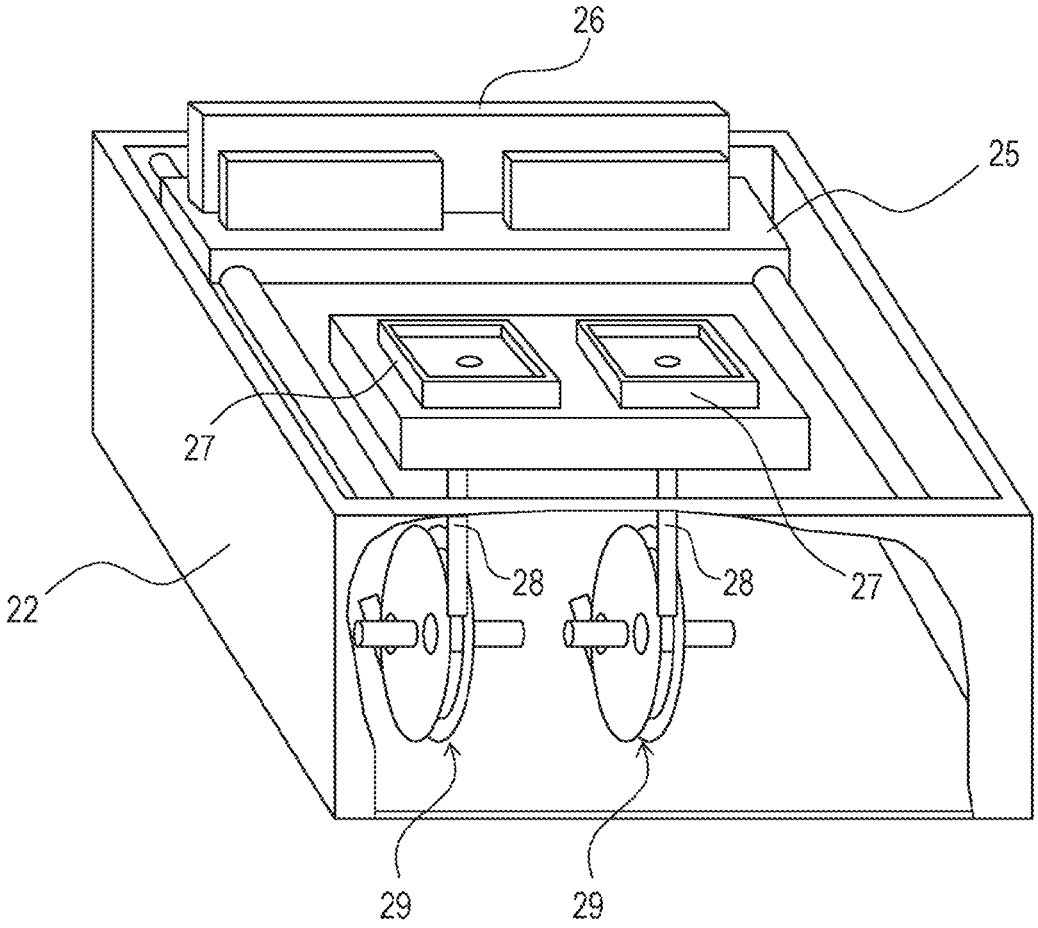
FIG. 2 is a schematic illustration of a recovery unit.

FIG. 2 is a schematic perspective view of an exemplary configuration of the recovery unit 22. A cap 27 is supported by a lifting mechanism (not illustrated) so as to be raised and lowered. The plurality of nozzles are capped at a high position of the caps 27. In this manner, during a non-print operation, the nozzles can be protected, or the nozzles can be subjected to a suction recovery operation. During a print operation, the cap 27 is lowered to a low position at which the cap 27 does not interfere with the operation performed by the print head 9. In order to remove ink deposited on the orifice face, a rubber wiper 26 supported by a wiper holder 25 wipes away the ink by sliding on the orifice face.

A suction pump 29 secures the caps 27 on the orifice face to form a closed space and generates a negative pressure inside the caps 27. In this manner, ink is loaded into the print head 9 and the nozzle. In addition, for example, dirt and dust, deposits, and air bubbles present in the ejection port or an ink channel inside the ejection port can be removed by suction. In the example illustrated in FIG. 2, the suction pump 29 configured as a tube pump is employed. The suction pump 29 includes a member having a curved surface that holds a flexible tube 28 (at least part of the flexible tube 28) therealong, a roller that can urge the flexible tube 28 against the member, and a rotatable roller supporting portion that supports the roller. By rotating the roller supporting portion in a predetermined direction, the roller rotates on the member having the curved surface formed thereon while crushing the flexible tube 28 therebetween. As a result, a negative pressure is generated in the closed space formed in the cap 7 so that the ink is sucked from the ejection port and is delivered from the cap 27 into the tube 28 or the suction pump 29. Thereafter, the delivered ink is transferred to an appropriate member (e.g., a waste ink absorber).

In addition to performing such suction recovery, the suction pump 29 can be actuated to remove ink that remains in the cap 27 through a preliminary ejecting operation performed with the cap 27 facing the orifice face. That is, by actuating the suction pump 29 when the amount of ink stored in the cap 27 by preliminary ejection has reached a predetermined value, the ink stored in the cap 27 can be transferred to the waste ink absorber via the tube 28.

(1-4) Purge Unit

The ink deposited on the surface of the head may include an altered component that is difficult to remove by only wiping. For example, such a case may occur when the ink contains a low-boiling, highly-volatile solvent (e.g., low molecular alcohol, such as IPA, ketones, such as MEK, or esters, such as ethyl acetate) or when the ink contains a lot of polymers for dispersing pigments. In addition, such a case may occur when the pigments of ink have weak dispersiveness and, thus, easily agglomerate. In general, such ink has initial viscosity that is the same as another type of ink and, therefore, any problem does not arise. However, if the ink is concentrated by evaporation, the viscosity is increased more than that of another type of ink. Thus, it is difficult to remove the ink by wiping, as compared with widely used ink.

For ink having a functionality that responds to a change in accordance with evaporation, the cleaning performance is extremely deteriorated, as compared with the above-described ink having a viscosity that simply increases in accordance with evaporation. Examples of such ink include ink having a phase change in accordance with evaporation or application of heat and ink that causes dispersion breakdown or that is solidified when the density increases due to evaporation.

If it is difficult to wipe away ink by using an existing wiping mechanism or if ink residue remaining after wiping is easily solidified, the head may be wiped using a sheet member. Examples of such a sheet member include a porous urethane foam, a melamine foam, and a non-woven fabric of polyolefin, PET, or nylon.

Figure 3A:
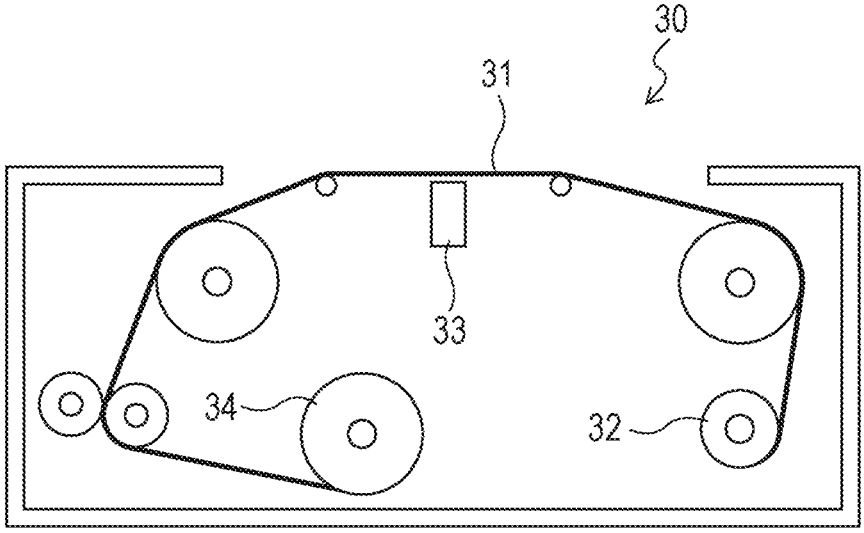
FIGS. 3A and 3B are schematic illustrations of a purge unit.

FIG. 3A illustrates the structure of the purge unit 30. The purge unit 30 includes a sheet member 31, a pressing member 33, a winding roller 32 that winds (collects) the sheet member 31, and a supply roller 34. The sheet member 31 pre-contains impregnating fluid. An example of the impregnating fluid is liquid, such as water, surfactant, or solvent.

Figure 3B:
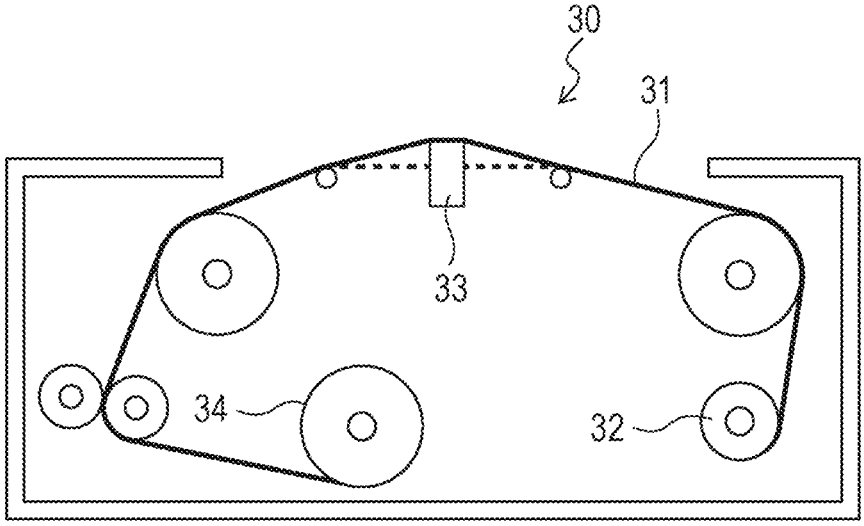

During a purge operation, the print head 9 moves to a position immediately above the purge unit 30 that is positioned in a non-printing area. At the same time, as illustrated in FIG. 3B, the pressing member 33 moves upward, and the unwound part of the sheet member 31 is maintained at a height of an orifice face 19 of the print head 9 (refer to FIGS. 7A to 7F). Subsequently, the print head 9 moves towards the part of the sheet member 31 held by the pressing member 33. The sheet member 31 is brought into contact with the orifice face 19 of the print head 9. In this manner, ink deposited on the orifice face 19 is absorbed by the sheet member 31. After the purge operation performed on the orifice face 19 is completed, the pressing member 33 is lowered, as illustrated in FIG. 3A. The winding roller 32 rotates so as to wind the sheet member 31 and, thus, an unused part of the sheet member 31 having no absorbed ink is fed out of the supply roller 34.

Such a purge operation can be performed for each of the scanning operations. However, the purge operation may be performed once every several scanning operations. As in the present exemplary embodiment, the purge unit can be used together with an existing wiper. However, only a purge operation using a purge member may be performed.

(2) Configuration of Control System

Figure 4:
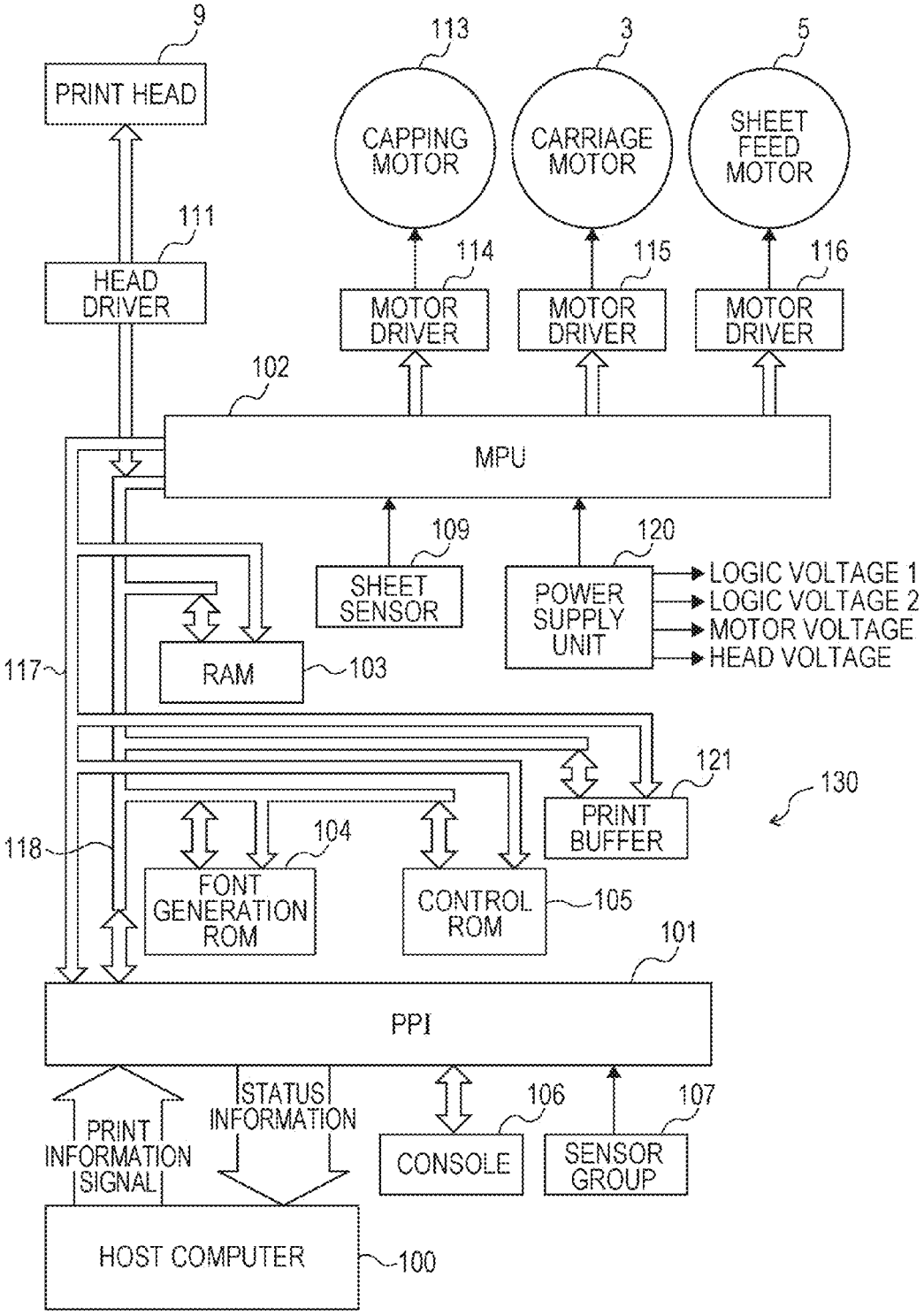
FIG. 4 is an overall control diagram of the printing apparatus.

FIG. 4 illustrates an exemplary configuration of a control circuit (a control unit 130) of the printer according to the present exemplary embodiment. A programmable peripheral interface (PPI) 101 receives a command signal and a printing information signal including print data transmitted from a host computer 100. Thereafter, the PPI 101 transfers the command signal and the printing information signal to a microprocessor unit (MPU) 102. The PPI 101 transmits status information regarding the printer to the host computer 100 as needed. In addition, the PPI 101 performs an I/O operation with a console 106 and receives signals input from a sensor group 107. The console 106 includes a setting input unit used for a user to input a variety of settings and a display unit that displays a message to the user. The sensor group 107 includes a home position sensor that detects whether the carriage unit 2 or the print head 9 is located at the home position and a capping sensor.

The MPU 102 controls all of the units of the printer in accordance with the procedure corresponding to a control program (described in more detail below) stored in a control read only memory (control ROM) 105. A random access memory (RAM) 103 is used as a work area of the MPU 102. The RAM 103 stores the received signals and temporarily stores various data. A font generation ROM 104 stores pattern information, such as characters and symbols corresponding to code information. The font generation ROM 104 outputs one of the pieces of the pattern information corresponding to input code information. A print buffer 121 temporarily stores the print data loaded into the RAM 103. The print buffer 121 has a capacity for several print lines. In addition to the above-described control program, the control ROM 105 can store constant data corresponding to data to be used in a control process (described in more detail below) (e.g., data required for determining whether to execute the purge operation). Such memory elements are controlled by the MPU 102 via an address bus 117 and a data bus 118.

A capping motor 113 acts as a drive source for lifting and lowering the caps 27, moving the wiper holder 25, and actuating the suction pumps 29. Motor drivers 114, 115, and 116 drive the capping motor 113, a carriage motor 3, and a sheet feed motor 5, respectively, under the control of the MPU 102.

A sheet sensor 109 detects the presence of a recording medium, that is, whether a recording medium is fed to a position at which the print head 9 can print data. A head driver 111 drives the print elements of the print head 9 in accordance with the printing information signal. A power supply unit 120 is disposed to supply power to each of the units. The power supply unit 120 includes an AC adaptor and a battery serving as a power supply device.

In a printing system including the above-described printer and the host computer 100 that supplies the printing information signal to the printer, when the host computer 100 transmits print data, the host computer 100 adds a predetermined command to the head of the print data. The print data are transmitted via, for example, a parallel interface port, an infrared port, or a network. For example, the following commands are added:

- the type of a recording medium on which data are to be printed (e.g., plain paper, an OHP sheet, or glossy paper and, in addition, a special type of a transfer printing film, thick paper, or banner paper)
- the size of the recording medium (e.g., A0, A1, A2, B0, B1, or B2)
- a print quality (e.g., draft, high quality, medium quality, enhancement of a particular color, or monochrome/color)
- a sheet feed path determined by the form or the type of a sheet feed unit (e.g., an automatic sheet feeder (ASF), manual, a sheet feed cassette 1, or a sheet feed cassette 2)
- ON/OFF of automatic detection of an object.

If a configuration in which process liquid for improving the fixing property of ink on the recording medium is applied is employed, information used for determining whether the application is activated may be transmitted as a command.

Using such a command, the printer reads, from the control ROM 105, data required for printing and performs a print operation on the basis of the data. Examples of the data include the number of print passes used when multipass printing is performed, an ink volume to be ejected per unit area of the recording medium, and information used to select one of printing methods. In some cases, the following data is additionally included: the type of mask for thinning data applied when multipass printing is performed, a drive condition of the print head 9 (e.g., the shape and the time length of a drive pulse applied to the print element), a dot size, a conveyance condition of a recording medium, and a carriage speed.

(3) Control Procedure (3-1) Recovery Sequence

Figure 5:
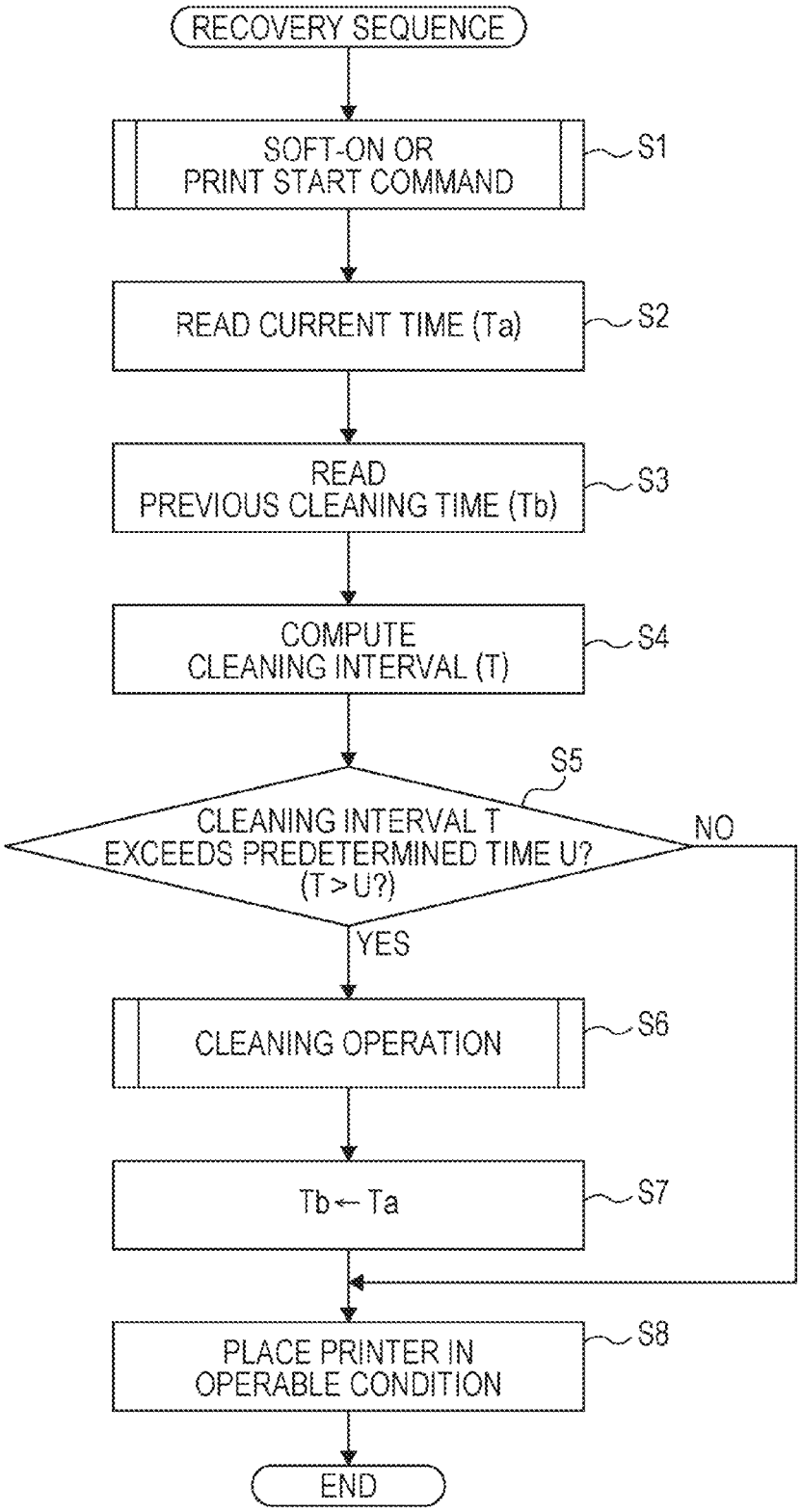
FIG. 5 illustrates the procedure of a recovery sequence.

FIG. 5 illustrates the recovery sequence (i.e., the sequence of cleaning the print head 9). The sequence starts when "soft-on" is executed or when a print start command is input from the host computer 100 (step S1). As used herein, the term "soft-on" refers to a secondary power-on operation for making printer functions actually executable after a primary power-on is performed. In step S2, a current time Ta is read first. Subsequently, in step S3, a time Tb at which the previous recovery process (the previous cleaning process) was performed is read. In step S4, the elapsed time (the cleaning interval T) is computed. In step S5, it is determined whether the cleaning interval T exceeds a predetermined threshold value U. If the cleaning interval T exceeds the predetermined threshold value U, a cleaning operation, that is, a preliminary ejection operation and a wiping operation are performed in step S6. After the cleaning operation is completed, the time Tb is set to the current time Ta in step S7 and, simultaneously, the printer is placed in an operable condition (step S8).

The cleaning interval T can be computed by acquiring the current time Ta using a calendar function provided by the MPU 102 or another appropriate unit and reading the time Tb stored in, for example, a register area of the RAM 103. Alternatively, by resetting and restarting a timer, such as a programmable interval timer (PIT) each time the cleaning operation is performed, the cleaning interval T can be obtained.

(3-2) Print Sequence

Figure 6:
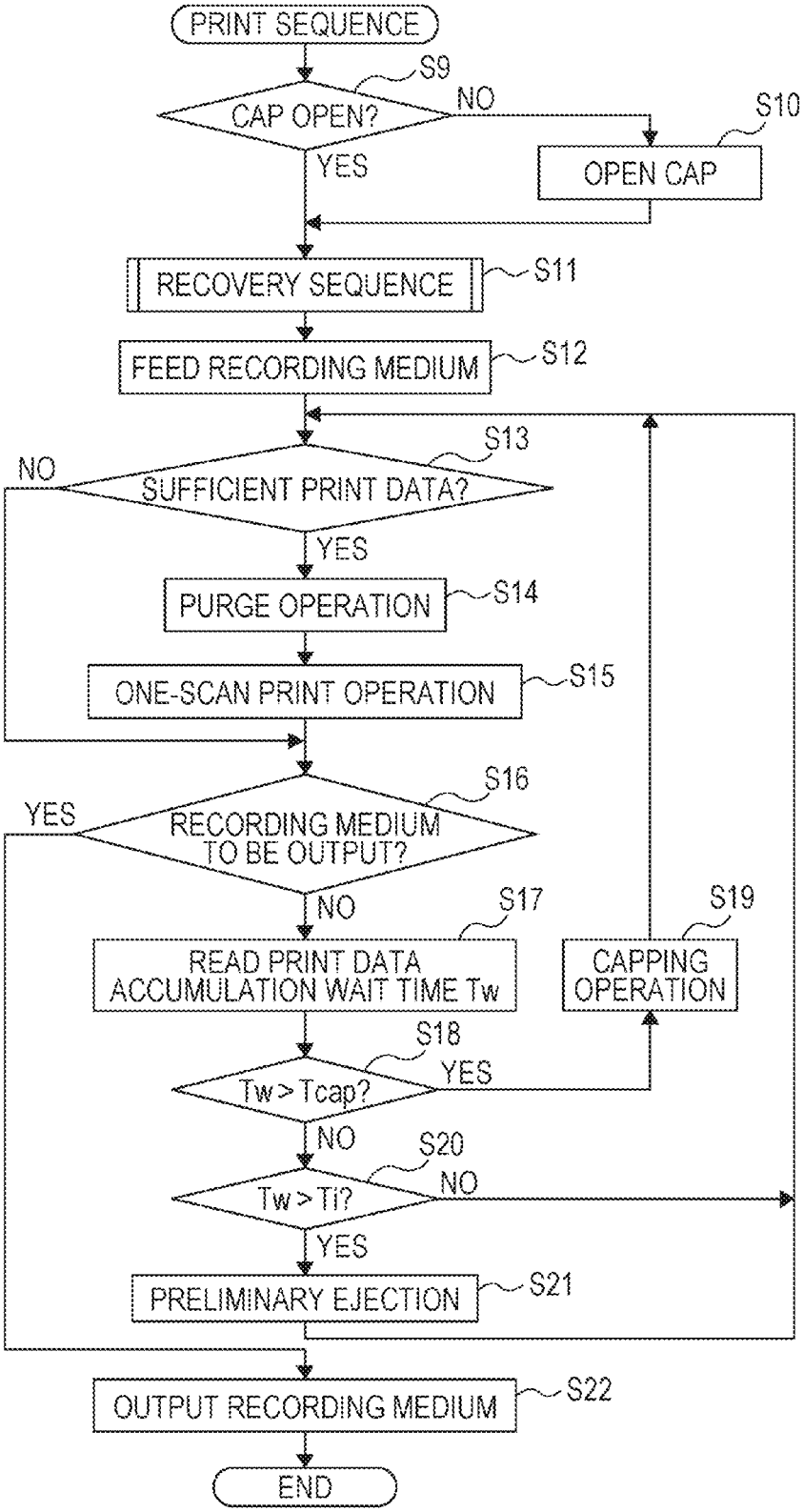
FIG. 6 is a flowchart of the procedure of a print sequence.

FIG. 6 illustrates a print sequence. When the printer is stopped, the print head 9 or the orifice face 19 of the nozzle is capped, as described above. Accordingly, before printing begins, the cap is removed so that the print head and the carriage unit 2 can perform a scan operation. For example, it is determined whether the cap is placed on the print head 9 or the nozzle on the basis of the detection result of a sensor (step S9). If the cap is placed on the print head 9 or the nozzle, the cap 27 is lowered and removed from the print head 9 or the nozzle (step S10). The sensor can be installed as one of the sensors in the sensor group 107.

In step S11, before printing begins, the recovery sequence illustrated in FIG. 5 is performed as needed, and a recording medium is fed (step S12). The recording medium is conveyed to the print start position. Thereafter, it is determined whether data required for one scan has been accumulated in the print buffer 121 (step S13). If, in step S13, it is determined that data required for one scan has been accumulated in the print buffer 121, the processing proceeds to a purge operation step (step S14), where the purge operation described in Section (1-4) is performed.

Figure 7A:
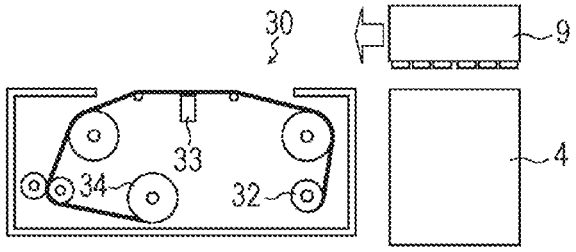
FIGS. 7A to 7F are schematic illustrations of the operation performed by the purge unit.
Figure 7B:
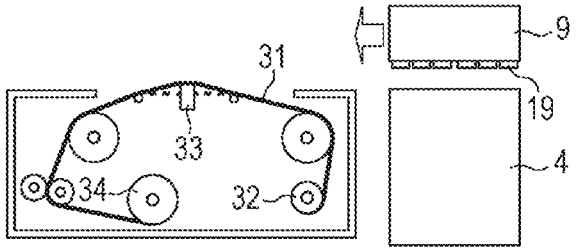
Figure 7C:
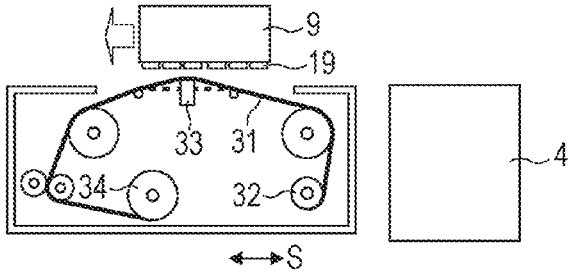
Figure 7D:
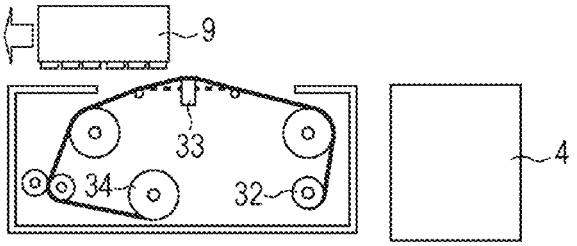
Figure 7E:
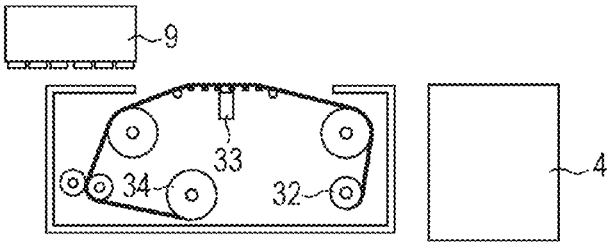
Figure 7F:
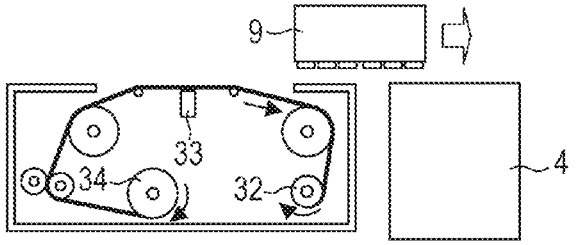

The operation performed by the purge unit is described next with reference to FIGS. 7A to 7F. As illustrated in FIG. 7A, upon completion of the operation performed by the print head 9 for one scan, the print head 9 moves towards a position at which the print head 9 faces the purge unit 30. If the print head 9 moves past a point above the platen 4, the pressing member 33 is lifted, as illustrated in FIG. 7B. The rewound part of the sheet member 31 is maintained at a height of the orifice face 19 of the print head 9. Subsequently, as illustrated in FIG. 7C, the print head 9 moves towards the sheet member 31 held by the pressing member 33 and the sheet member 31 is urged against the orifice face 19 of the print head 9. In this manner, the orifice face 19 of the print head 9 that faces the sheet member 31 slides on the sheet member 31 and is cleaned by the sheet member 31. As illustrated in FIG. 7D, the pressing member 33 is maintained at the height of the orifice face 19 until the print head 9 has moved past the pressing member 33. As illustrated in FIG. 7E, after the purge operation is completed, the pressing member 33 is lowered to the height of the platen 4. Thereafter, as illustrated in FIG. 7F, the winding roller 32 rotates so that the unwound part of the sheet member 31, that is, the part of the sheet member 31 that is used for cleaning the orifice face 19 is wound around the winding roller 32. Simultaneously, an unused part of the sheet member 31 is fed from the supply roller 34.

The purge operation illustrated in FIGS. 7A to 7F may be performed for each of the scans, as illustrated in FIG. 6. Alternatively, the purge operation may be performed once every several scans or at a predetermined timing determined by the number of ejections and a timer. The carriage unit 2 is moved by the carriage motor 3 to perform a scanning operation and a print operation for the accumulated data (step S15). Subsequently, it is determined whether the operations are completed for data of one page of the recording medium and whether the recording medium is to be output in accordance with a sheet ejection command (step S16). If it is determined that the recording medium is to be output, the recording medium is output (step S22). Thus, the sequence is completed.

After a print operation for one scan is completed (step S15) or if, in step S13, it is determined that sufficient data has not been accumulated, the processing proceeds to step S16 and, subsequently, a print data accumulation wait time Tw for the scan is read (step S17). This wait time can be obtained by, for example, using the above-described timer and measuring an elapsed time since when, in step S13, it is determined first that data has yet not been accumulated for each of the scans. Subsequently, it is determined whether the print data accumulation wait time Tw exceeds a predetermined time Tcap (step S18). If it is determined that the print data accumulation wait time Tw does not exceed the predetermined time Tcap, it is further determined that the print data accumulation wait time Tw exceeds a predetermined time Ti (step S20). If it is determined that the print data accumulation wait time Tw does not exceed the predetermined time Ti, the processing returns to step S13. After the data for one scan is printed, the determination of step S13 is made for print data for the next scan.

If, in step S18, it is determined that the print data accumulation wait time Tw exceeds the predetermined time Tcap, a capping operation is performed in step S19. Thereafter, the processing returns to step S13, where the processing waits until the sufficient amount of data are accumulated.

However, if, in step S20, it is determined that the print data accumulation wait time Tw exceeds the predetermined time Ti, the processing proceeds to step S21, where preliminary ejection is performed. Thereafter, the processing returns to step S13, where the processing waits until a sufficient amount of data is accumulated. The relationship between the predetermined time Ti and the predetermined time Tcap can be determined as follows: $Ti<Tcap$.

According to the exemplary embodiments, in the purge operation (step S14) illustrated in FIG. 6, the amount of winding of the sheet member 31 (the length of part of the sheet member 31 to be wound after the orifice face 19 of the print head 9 is cleaned) is set to an appropriate amount in accordance with the use condition of the sheet member 31. Accordingly, the design is such that the amount of winding of the sheet member 31 is changeable in accordance with the number of ink ejections executed in the print operation performed between the immediately previous two purge operations. The exemplary embodiments are described in more detail below.

First Exemplary Embodiment

Figure 8A:
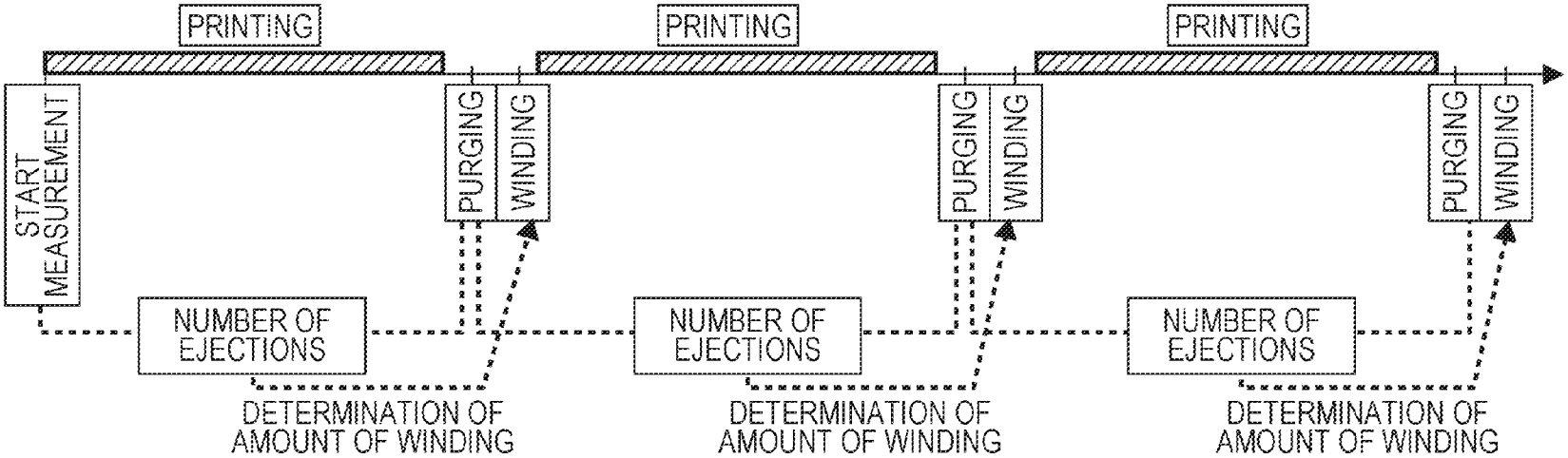
FIGS. 8A and 8B are schematic illustrations of a purge operation sequence according to a first exemplary embodiment of the present invention.
Figure 8B:
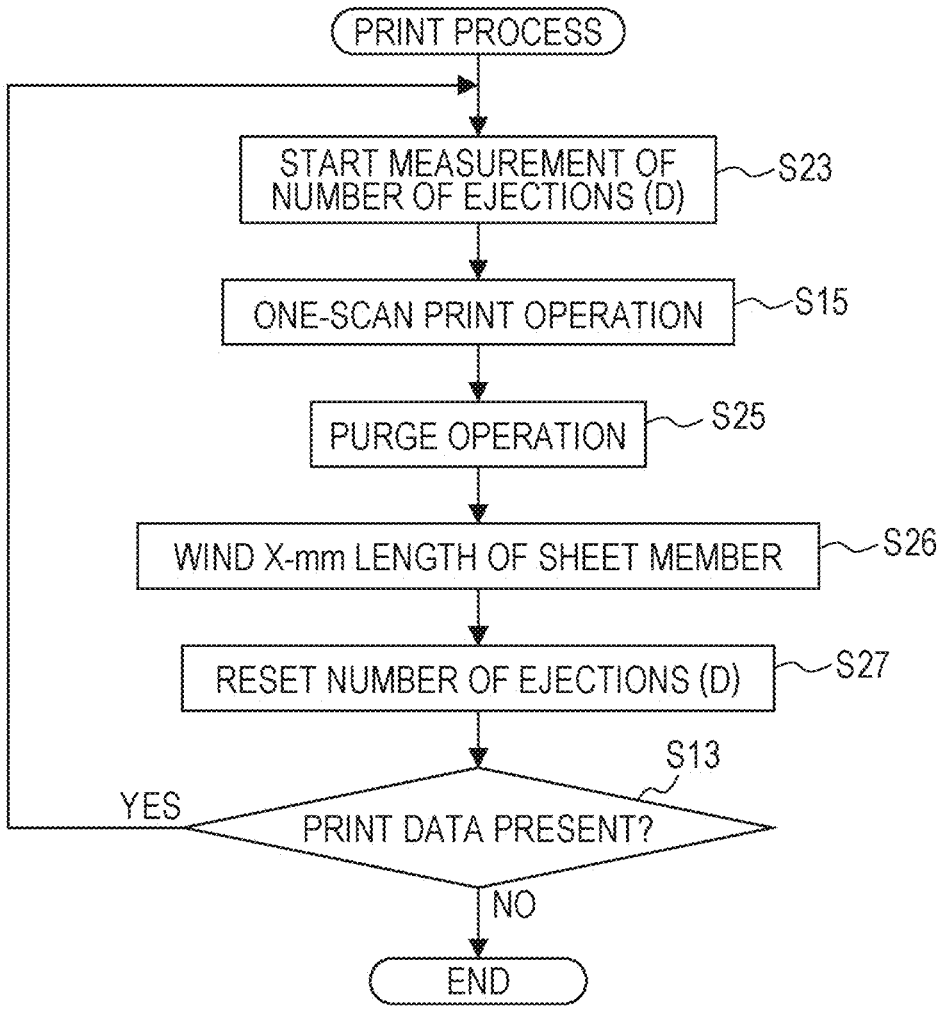

A first exemplary embodiment of the present invention is described below with reference to the above-described configuration. In the present exemplary embodiment, the purge operation is performed for each of the scanning operations. The schematic purge sequence (step S14) in the print sequence illustrated in FIG. 6 and the flowchart of the purge sequence are illustrated in FIGS. 8A and 8B.

If data for one scan is accumulated in the print buffer 121 after a print process begins, measurement of the number of ink ejections (D) from all of the nozzles during the print operation is started (step S23). Immediately after the measurement is started, the print operation for one scan is started (step S15). The number of ink ejections (D) can be measured using an ejection count measuring unit on the basis of, for example, print data stored in the print buffer 121 and font data stored in the font generation ROM 104. The ejection count measuring unit includes the MPU 102 that measures the number of ejections. The ejection count measuring unit further includes a counter that is set in, for example, the RAM 103 and that stores the number of ink ejections (D).

After a one-scan operation is completed, the purge operation (step S25) illustrated in FIGS. 7A to 7E is performed. Part of the sheet member 31 used in the purge operation is collected through the winding operation illustrated in FIG. 7F (step S26). The amount of winding (X) is selected from Table 1 in accordance with the number of ink ejections (D) measured by the ejection count measuring unit during the print operation for a predetermined area range (for one scan in this case) corresponding to the purge operation performed immediately before the winding step. As used herein, the term "number of ink ejections (D)" refers to the number of ink ejections between the last but one purge operation and the last purge operation when this winding step is considered as a reference. In the winding step performed after the first one-scan operation performed first after the printer is turned on, the number of ink ejections (D) is the number of ejections executed from when the printed is turned on to when the first purge operation is performed. However, the relationship between the number of ejections and the amount of winding (X) is not limited to the three-step relationship illustrated in Table 1. The relationship may be a two-step relationship or a four-step or more step relationship. Alternatively, the relationship may be determined so that the amount of winding (X) continuously increases with increasing number of ejections.

TABLE 1

| Number of Ejections: D | Amount of Winding: X |
|---|---|
| $D < 1 \times 10^8$ | 3 mm |
| $1 \times 10^8 \leq D < 5 \times 10^8$ | 5 mm |
| $5 \times 10^8 \leq D$ | 7 mm |

The amount of winding is controlled so as to increase as the number of ejections increases. This is because the amount of ink mist increases as the number of ejections increases and, therefore, the amount of mist deposited on the orifice face 19 of the print head 9 increases. If the orifice face 19 having a large amount of mist deposited thereon is cleaned, the mist purged onto the sheet member 31 bleeds. Accordingly, the width of a wiping trace on the sheet member 31 increases. As used herein, the term "wiping trace" refers to an ink line produced on the sheet member due to the purge operation. However, by increasing the amount of winding, the whole area in which the mist bleeds can be collected. Thus, the surface of the sheet member after the winding operation is performed can be used as an unused part. In contrast, when the orifice face 19 having only a small amount of mist is cleaned, the width of the wiping area is small, since the mist in the wiping area of the sheet member 31 negligibly bleeds. Thus, by reducing the amount of winding, excessive winding of the sheet member can be prevented.

That is, when an image having a low density (i.e., a high throughput oriented image) is printed, the amount of winding of the sheet member is decreased since the number of ejections is small. In contrast, when a high density image (i.e., a high quality oriented image) is printed, the amount of winding of the sheet member is increased since the number of ejections is large.

Subsequently, the counter storing the number of ejections is reset (step S27). Thereafter, it is determined whether print data is present (step S13). If print data is present, measurement of the number of ejections is started again (step S23), and the above-described process flow is repeated. However, if print data is not present, the print process is completed. As described above, the present exemplary embodiment is characterized in that a predetermined length of the sheet member is wound immediately after the purge operation is performed, and the length is predetermined in accordance with the number of ejections, as illustrated in FIG. 8A. In this manner, ink deposited on the orifice face of the print head can be sufficiently purged. In addition, the length of the sheet member wound (used) can be set to an optimal value.

Example 1

Figure 9A:
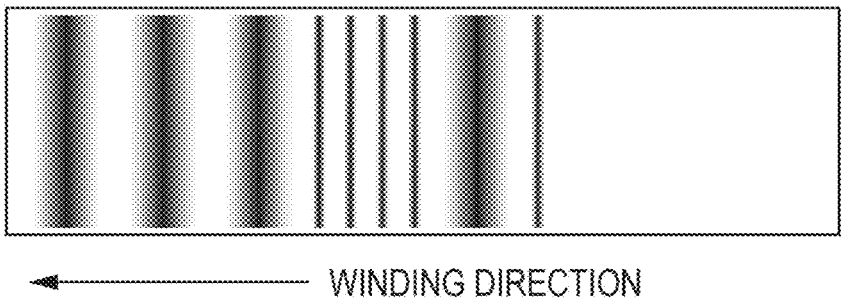
FIGS. 9A to 9C illustrate wiping traces appearing on a sheet member in Example 1 and Comparative examples 1 and 2, respectively.

FIG. 9A illustrates an example of wiping traces (areas used for the purge operation) of the sheet member 31 after the sequence illustrated in FIGS. 8A and 8B is performed. In FIG. 9A, the winding direction is indicated by an arrow. Thus, the trace generated in the first purging operation is leftmost. Since the number of ink ejections (D) is greater than or equal to $5\times10^8$ in first three scans and the eighth scan, the amount of winding is 7 mm, according to Table 1. In addition, since the number of ink ejections (D) is less than $1\times10^8$ in each of the fourth to seventh scans and ninth scan, the amount of winding is 3 mm, according to Table 1.

Comparative Example 1

Figure 9B:
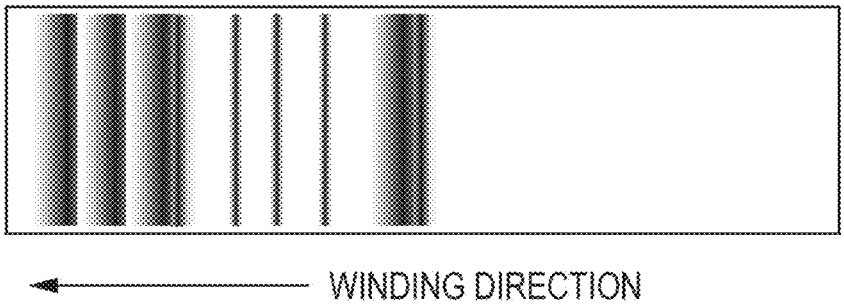

The amount of winding is fixed to 3 mm for each of the scans, and a print operation that is similar to that in Example 1 is performed. FIG. 9B illustrates wiping traces appearing on the sheet member 31 at that time. Since, in the first three scans and the eighth scan, the amount of winding is small after the scan is completed, the wiping operation starts at used part of the sheet member 31 in the second to fourth scans and the ninth scan. Therefore, the wiping traces overlap each other.

Comparative Example 2

Figure 9C:
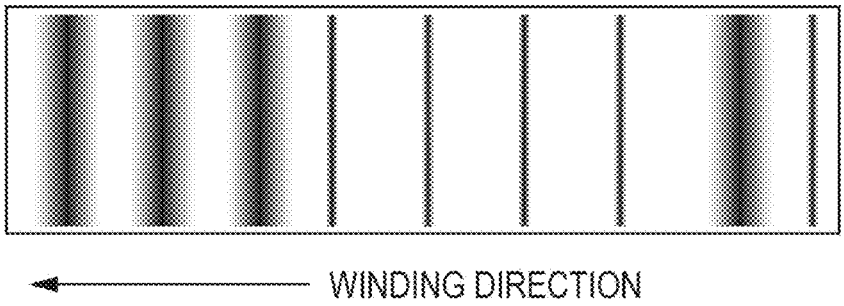

The amount of winding is fixed to 7 mm for each of the scans, and a print operation that is similar to that in Example 1 is performed. FIG. 9C illustrates the wiping traces appearing on the sheet member 31 at that time. In each of the fourth to seventh scan, since the amount of winding is large after the scan is completed, the distance between the adjacent wiping traces is large. Therefore, a large unused area appears between the areas used for the wiping operation.

Table 2 summarizes the results of Example 1 and Comparative examples 1 and 2. In Example 1, the amount of winding is varied in accordance with the number of ejections. Accordingly, unlike Comparative example 1 in which the wiping traces on the sheet member 31 overlap each other, the purge performance is not degraded. In addition, the amount of used part of the sheet member 31 is made smaller than that of Comparative example 2.

TABLE 2

| | Amount Used | Overlap of Wiping Traces |
|---|---|---|
| Example 1 | 43 mm | No |
| Comparative Example 1 | 27 mm | Yes |
| Comparative Example 2 | 63 mm | No |

Second Exemplary Embodiment

Figure 10A:
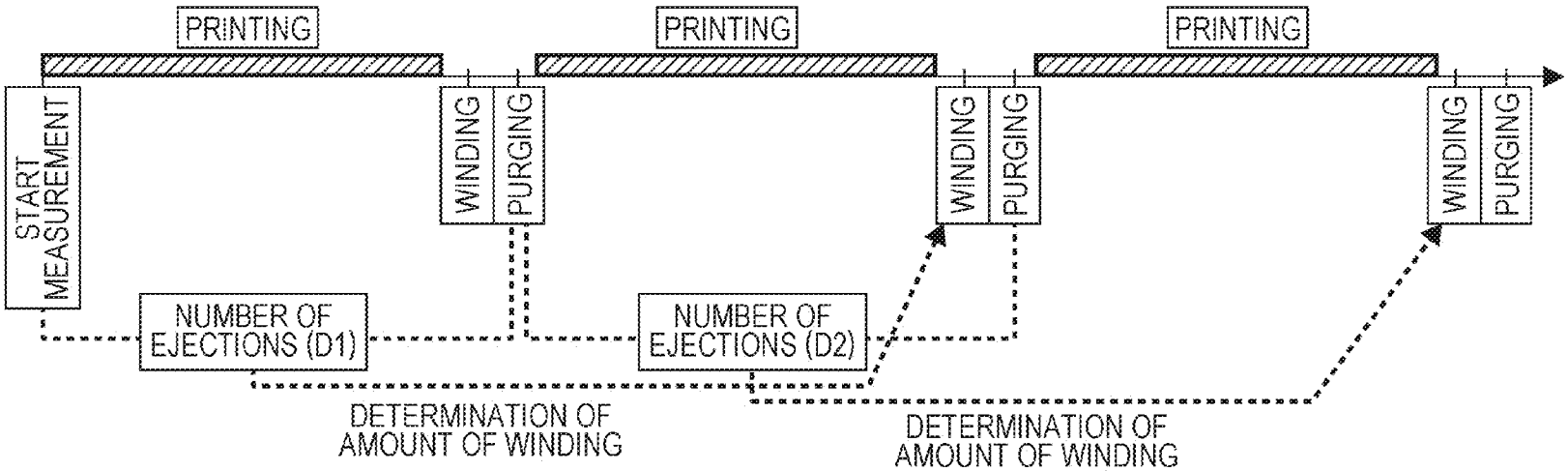
FIGS. 10A and 10B are schematic illustrations of a purge operation sequence according to a second exemplary embodiment of the present invention.
Figure 10B:
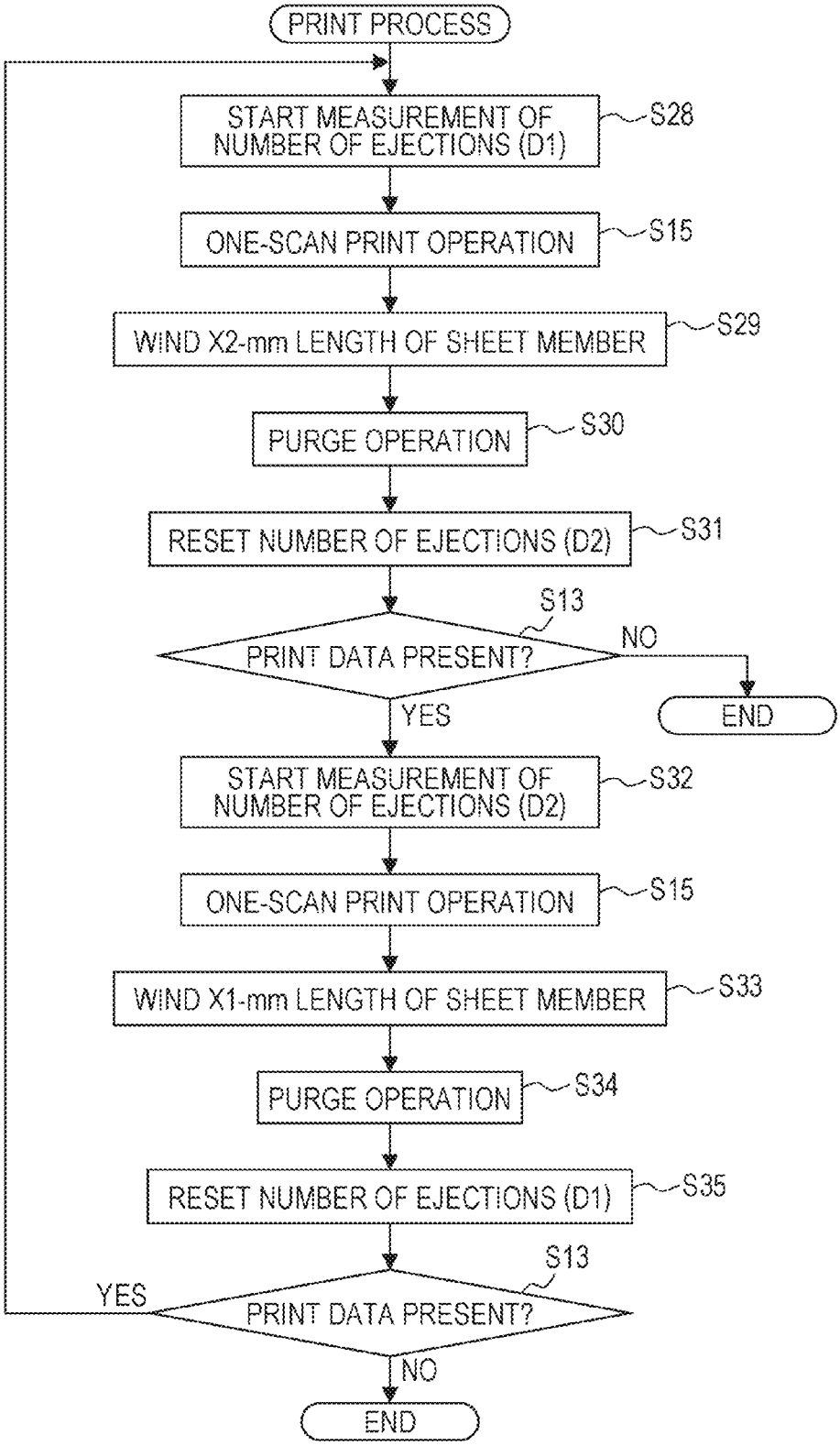

Like the first exemplary embodiment, the purge operation is performed for each of the scans. According to the present exemplary embodiment, the sequence in the wiping operation (step S14) in the print sequence illustrated in FIG. 6 differs from that of the first exemplary embodiment. The schematic sequence in the wiping operation (step S14) and the flowchart of the sequence are illustrated in FIGS. 10A and 10B.

If data for one scan is accumulated in the print buffer 121 after the print process begins, measurement of the number of ink ejections (D1) is started (step S28). Immediately after the measurement is started, the print operation for one scan is started (step S15). After the one-scan operation is completed, part of the sheet member 31 used in the previous purge operation is collected through the winding operation illustrated in FIG. 7F (step S29). The amount of winding (X2) is selected from Table 1 in accordance with the number of ink ejections (D2) measured by the ejection count measuring unit during the print operation for a predetermined area range (an area for one scan in this case) corresponding to the purge operation performed immediately before the winding step. The number of ink ejections (D2) is the same as the number of ejections executed from when the purge operation before last is performed to when the last purge operation is performed.

The amount of winding is controlled so as to increase as the number of ejections increases. This is because the amount of mist increases if the number of ejections increases and, therefore, the amount of mist deposited on the orifice face 19 of the print head 9 increases. Accordingly, the amount of bleeding of ink in the wiping trace increases and, thus, the width of the wiping trace increases. After the winding operation is completed, the purge operation illustrated in FIGS. 7A to 7E is performed (step S30). Subsequently, the counter storing the number of ejections (D2) is reset (step S31). Thereafter, it is determined whether print data is present (step S13).

If print data is not present, the print operation is completed. However, if print data is present, measurement of the number of ejections (D2) is started (step S32). Immediately after the measurement is started, a print operation for one scan is started (step S15). After the print operation for one scan is completed, part of the sheet member 31 used for the previous purge operation is collected through the winding operation illustrated in FIG. 7F (step S33). The amount of winding (X1) is selected from Table 1 in accordance with the number of ink ejections (D1) measured by the ejection count measuring unit during the print operation for a predetermined area range corresponding to the purge operation performed immediately before the winding step. After the winding operation is completed, a purge operation illustrated in FIGS. 7A to 7E is performed (step S34). Subsequently, the counter storing the number of ejections (D1) is reset (step S35). Thereafter, it is determined whether print data is present (step S13). If print data is present, measurement of the number of ejections (D1) is started again (step S28), and the above-described process flow is repeated. However, if print data is not present, the print process is completed.

As described above, the present exemplary embodiment is characterized in that as illustrated in FIG. 10A, the sheet member is wound immediately before the purge operation is performed, and the length of the sheet member wound is determined in accordance with the number of ejections executed from when the last but one purge operation is performed to when the last purge operation is performed. In this manner, ink deposited on the orifice face of the print head can be sufficiently purged. In addition, the length of the sheet member used for the purge operation can be set to an optimal value.

Note that according to the present exemplary embodiment, part of the sheet member 31 used is wound immediately before the purge operation is performed. Accordingly, the purge operation can be performed immediately after the sheet member 31 is fed out of the supply roller 34.

Furthermore, according to the present exemplary embodiment, the winding operation can be performed at any time between the previous purge operation and the next purge operation. That is, according to the first exemplary embodiment, only one counter for storing the number of ejections is provided. Accordingly, the counter needs to be reset before a print operation begins and, therefore, the winding operation that uses a counter value needs to be started before the print operation begins. Thus, in reality, as illustrated in FIG. 8A, the point in time at which the winding operation is started is limited to a point in time immediately before the print operation begins. In contrast, according to the present exemplary embodiment, a counter that operates during a print operation and a counter that is referenced during the winding operation are provided. Thus, the winding operation can be performed regardless of whether the print operation is being performed. At least two counters are needed. However, three or more counters may be provided. At that time, it is only required that the numbers of ink ejections measured in any two continuous print operations be stored in two different counters among the above-described at least two counters.

Example 2

Figure 11A:
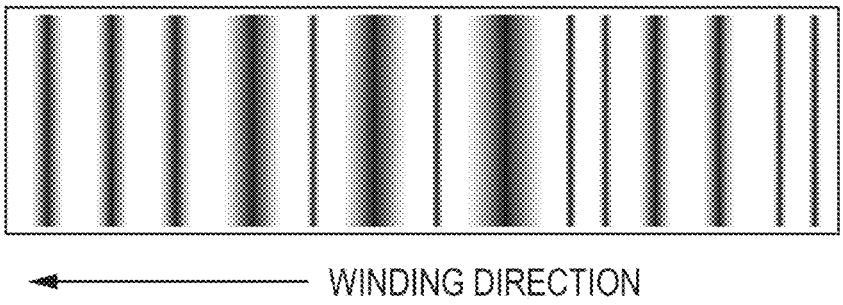
FIGS. 11A to 11C illustrate wiping traces appearing in a sheet member in Example 2 and Comparative examples 3 and 4, respectively.

FIG. 11A illustrates an example of a wiping trace (an area used for a purge operation) appearing on the sheet-like member 31 when the sequence of processes illustrated in FIGS. 10A and 10B is performed. In FIG. 11A, the winding direction is indicated by an arrow. Thus, the trace generated in the first purging operation is leftmost. Since the number of ink ejections (D) is greater than or equal to $5\times10^8$ in each of the fourth, sixth, and eighth scans, the amount of winding is 7 mm, according to Table 1. In addition, since the number of ink ejections (D) is greater than or equal to $1\times10^8$ and less than $5\times10^8$ in each of the first three scans and the eleventh and twelfth scans, the amount of winding is 5 mm, according to Table 1. Furthermore, since the number of ink ejections (D) is less than $1\times10^8$ in each of the fifth, seventh, ninth, tenth, thirteenth, and fourteenth scans, the amount of winding is 3 mm, according to Table 1.

Comparative Example 3

Figure 11B:
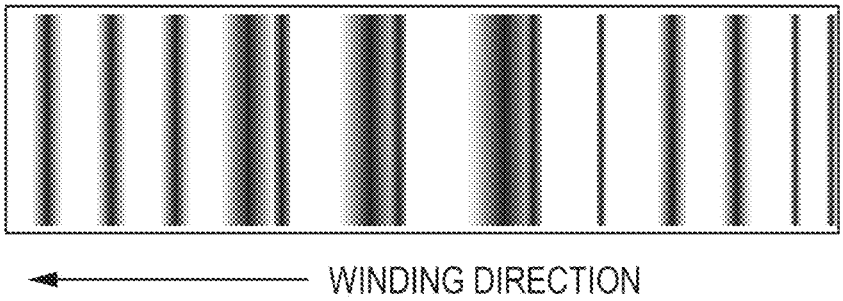

The amount of winding is fixed to 5 mm for each of the scans, and a print operation that is similar to that in Example 2 is performed. FIG. 11B illustrates the wiping trace appearing on the sheet member 31 at that time. Since, in the fourth, sixth, and eighth scans, the amount of winding is small after the scan is completed, the purge operation starts from a used part of the sheet member 31 in each of the fifth, seventh, and ninth scans. Therefore, the wiping traces overlap each other.

Comparative Example 4

Figure 11C:
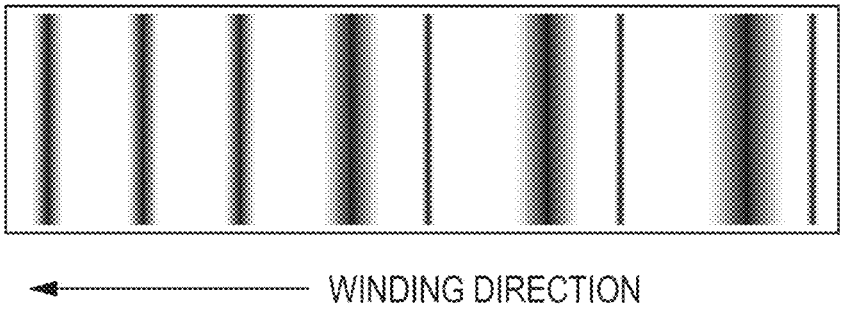

The amount of winding is fixed to 7 mm for each of the scans, and a print operation that is similar to that in Example 2 is performed. FIG. 11C illustrates the wiping trace appearing on the sheet member 31 at that time. In each of the first three scans and the fifth, seventh, and ninth scans, since the amount of winding is large after the scan is completed, the distance between the adjacent wiping traces is large. Therefore, a large unused area appears between the areas used for the purge operations.

Table 3 summarizes the results of Example 2 and Comparative examples 3 and 4. In Example 2, the amount of winding is varied in accordance with the number of ejections. Accordingly, unlike Comparative example 3 in which the wiping traces on the sheet member 31 overlap each other, the purge performance is not degraded. In addition, the amount of a used part of the sheet member 31 is made smaller than that of Comparative example 4.

TABLE 3

| | Amount Used | Overlap of Wiping Traces |
|---|---|---|
| Example 2 | 71 mm | No |
| Comparative Example 3 | 75 mm | Yes |
| Comparative Example 4 | 105 mm | No |

Third Exemplary Embodiment

According to the present exemplary embodiment, the amount of winding of the sheet member 31 is controlled while taking into account the mist depositability on the print head due to a factor other than the number of ink ejections. Hereinafter, description of the same or similar element and function to that of the first or second exemplary embodiment is not repeated.

According to the present exemplary embodiment, when the amount of winding of the sheet member 31 is selected from Table 1 in accordance with the number of ejections, the mist depositability on the print head in accordance with the distance between the print head and the recording medium (the print head-to-recording medium distance) and the humidity in the vicinity of the apparatus is taken into account. Thus, more accurate control can be performed. The number of ejections that takes into account the mist depositability is computed as follows:

Number of ejections that takes into account the mist depositability=(number of ejections between purge operations)×(print head-to-recording medium distance coefficient)×(humidity coefficient).

Note that only one of (print head-to-recording medium distance coefficient) and (humidity coefficient) may be used. The terms in the equation are described below.

Print Head-to-Recording Medium Distance

According to the present exemplary embodiment, the print head-to-recording medium distance can be varied using a carriage lifting mechanism (not illustrated). The print head-to-recording medium distance can be switched to the following five positions in accordance with the type of the recording medium or the environmental condition or by a user: "low", "moderately low", "normal", "moderately high", and "high".

As the print head-to-recording medium distance increases, the amount of mist deposited on the print head increases. This is because if the print head-to-recording medium distance increases, a mist particle having a low mass or a low ejection speed does not reach the recording medium and is easily suspended in air (or is easily deposited on the surface of the print head). Accordingly, in the present exemplary embodiment, as illustrated in Table 4, the number of ejections measured between the purge operations is multiplied by a coefficient predetermined in accordance with the print head-to-recording medium distance (i.e., a distance coefficient). Thus, the number of ejections is weighted. In this manner, the amount of winding of the sheet member 31 is controlled. More specifically, the number of ejections is multiplied by a distance coefficient to obtain the number of ejections corrected by the distance coefficient. Thereafter, a winding unit of the sheet member 31 is controlled on the basis of the corrected number of ejections.

TABLE 4

| Print Head-to-Recording Medium Distance | Print Head-to-Recording Medium Distance Coefficient |
|---|---|
| low (small) | 0.4 |
| moderately low (moderately small) | 0.6 |
| normal | 0.8 |
| moderately high (moderately large) | 1 |
| high (large) | 1.2 |

Humidity Around Apparatus

The amount of mist deposited on the print head increases depending on the use environment of the apparatus. In particular, as the humidity decreases, the amount of mist deposited on the print head increases. This is because if the humidity decreases, evaporation of ejected ink is facilitated and, thus, the mass or the ejection speed of the mist particle decreases. The mist particle having a low mass or a low ejection speed does not reach the recording medium and is easily suspended in air (or is easily deposited on the surface of the print head). Accordingly, in the present exemplary embodiment, the humidity in the vicinity of an inkjet print head unit is measured by a humidity measuring unit (a humidity sensor, not illustrated). The number of ejections is multiplied by a humidity coefficient corresponding to the number of ejections illustrated in Table 5. Thus, the number of ejections measured between the purge operations is weighted. In this manner, the amount of winding of the sheet member 31 is controlled. More specifically, the number of ejections is multiplied by a humidity coefficient to obtain the number of ejections corrected by the humidity coefficient. Thereafter, a winding unit of the sheet member 31 is controlled on the basis of the corrected number of ejections.

TABLE 5

| Humidity | Humidity Coefficient |
|---|---|
| to 30% | 1 |
| 30% to 60% | 0.9 |
| 60% to | 0.8 |

According to the present exemplary embodiment, the amount of winding of the sheet member 31 is controlled in accordance with the number of ejections multiplied by the distance coefficient and a humidity coefficient while taking into account the mist depositability on the print head. Accordingly, degradation of the image quality due to, for example, ink ejection failure or color mixture can be prevented. In addition, the length of the sheet member 31 used can be reduced. In the present exemplary embodiment, the length of the sheet member 31 used can be reduced more than in the first and second exemplary embodiments.

Fourth Exemplary Embodiment

According to the present exemplary embodiment, when the print head is driven using a block driving method, the amount of winding of the sheet member 31 is controlled by taking into account a unique characteristic in that the amount of generated mist significantly varies in accordance with the order in which the blocks are driven. Hereinafter, description of the same or similar element and function to that of the first, second, or third exemplary embodiment is not repeated.

In the block driving method, all of the nozzles of the print head do not eject ink at the same time. Ejection is sequentially performed on a block basis, where the block includes a predetermined number of nozzles. The block driving method has an advantage that the power required for ejection at one time is small, for example.

However, depending on the configuration of a print head, the sequence of driving blocks (the block driving sequence) may have an impact on the image quality and the amount of generated mist. According to the present exemplary embodiment, to address such an issue, one of two different block driving sequences is selected in accordance with a print mode.

Figure 12A:
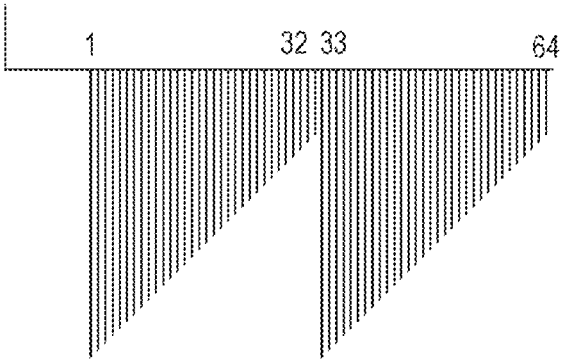
FIGS. 12A and 12B illustrate a block driving method according to a fourth exemplary embodiment of the present invention.
Figure 12B:
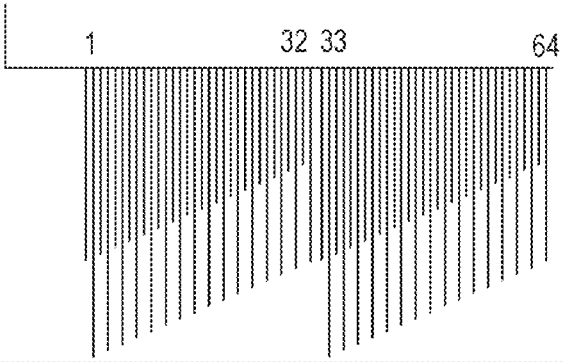

According to the present exemplary embodiment, 1280 nozzles are divided into 32 blocks each including 40 nozzles. The blocks are driven at 32 different points in time in a time division manner. In a poster/picture mode in which a poster or a picture is mainly printed, it is desirable that a block driving sequence A be employed. In contrast, in a line drawing mode in which a line drawing, such as a computer aided design (CAD) drawing, is mainly printed, it is desirable that a block driving sequence B be employed. The block driving sequences A and B are illustrated in FIGS. 12A and 12B, respectively. In FIGS. 12A and 12B, the nozzles having nozzle numbers 1 to 64 are arranged in a nozzle arrangement direction in the order from the nozzle number 1 to the nozzle number 64. In the following description, a nozzle having a nozzle number N (N is an integer greater than or equal to 1) is referred to as an "#N nozzle".

Nozzles 1 to 32 of the block driving sequence A are discussed first. The #1 to #32 nozzles are arranged up side by side, and ink is sequentially ejected in the order from the #1 to #32 nozzles. In the same manner, ink is sequentially ejected from the #33 to #64 nozzles. In such a case, the difference between the time when the #32 nozzle ejects ink and the time when the #33 nozzle ejects ink is large. This slight time difference may cause ink dot misalignment. However, the amount of mist is smaller than in the block driving sequence B.

Nozzles 1 to 32 of the block driving sequence B are discussed next. Unlike the block driving sequence A, ink is sequentially ejected from #2, #4, . . . , and #32 nozzles. Subsequently, ink is sequentially ejected from #1, #3, . . . , and #31 nozzles. In the same manner, ink is sequentially ejected from the #33 to #64 nozzles. Thus, the difference between the times at which adjacent nozzles eject ink is substantially constant. Consequently, the difference between the time when the #32 nozzle ejects ink and the time when the #33 nozzle ejects ink is small. Accordingly, ink dot misalignment negligibly occurs. However, the amount of mist is larger than in the block driving sequence A.

The difference between the amounts of mist in the block driving sequences A and B results from the following reasons. In the block driving sequence A, a nozzle is affected by ejection performed by the adjacent nozzle, and the meniscus condition of the nozzle immediately before ejection tends to be unstable. Thus, the ejection speed is decreased and, therefore, the amount of mist is smaller than in the block driving sequence B. In contrast, in the block driving sequence B, a nozzle is negligibly affected by ejection performed by the adjacent nozzle, and the meniscus condition of the nozzle immediately before ejection tends to be stable. Thus, the ejection speed is increased and, therefore, the amount of mist is larger than in the block driving sequence A.

According to the present exemplary embodiment, such characteristics are utilized. That is, the block driving sequence A is employed for the poster/picture mode in which multi-pass printing is mainly performed, since ink dot misalignment caused by a slight difference between ejection times of two blocks is unnoticeable. In contrast, in a line drawing mode in which low pass printing is mainly performed, the block driving sequence B is employed, since ink dot misalignment caused by a slight difference between ejection times of two blocks is unnoticeable even in the low pass printing.

According to the present exemplary embodiment, by taking into account the difference between the mist depositabilities in the two block driving sequences, the actual number of ejections is obtained as follows:

The number of ejections that takes into account mist depositability=(the number of ejections between purge operations)×(print head-to-recording medium distance coefficient)×(humidity coefficient)×(ejection time difference coefficient).

The ejection time difference coefficient is illustrated in Table 6. The ejection time difference coefficient increases with decreasing maximum value of a time difference between ejection times of two adjacent nozzles (in the block driving sequence A, the #32 nozzle and the #33 nozzles generate the maximum value of a time difference between ejection times). That is, the ejection time difference coefficient decreases with increasing maximum value of a time difference between ejection times of two adjacent nozzles.

TABLE 6

| Block Driving Sequence | Ejection Time Difference Coefficient |
|---|---|
| A | 0.3 |
| B | 1 |

According to the present exemplary embodiment, in order to take into account the mist depositability on the print head, the number of ejections is multiplied by the ejection time difference coefficient in addition to the distance coefficient and the humidity coefficient to obtain the "number of ejections that takes into account mist depositability". However, it is not necessary to use all of the coefficients. Any appropriate combination of the coefficients may be used. The amount of winding of the sheet member 31 is controlled in accordance with the "number of ejections that takes into mist depositability". Thus, degradation of the image quality caused by ink ejection failure and color mixture can be prevented. In addition, the length of the sheet member 31 used can be reduced. According to the present exemplary embodiment, the length of the sheet member 31 used can be more reduced than in the first to third exemplary embodiment.

The amount of mist deposited on the print head is also affected by the ink ejection volume and the type of ink. Accordingly, the amount of winding of the sheet member 31 may be controlled by multiplying the number of ejections measured between purge operations by coefficients predetermined in accordance with the ink ejection volume and the type of ink (i.e., an ink ejection volume coefficient and an ink type coefficient). Tables 7 and 8 illustrate the ink ejection volume coefficient and the ink type coefficient, respectively. The ink ejection volume coefficient decreases with decreasing ink ejection volume in one ejecting operation performed by the nozzle and increases with increasing ink ejection volume. The ink type coefficient is set in accordance with the type of ink. All of a total of five coefficients (i.e., these two coefficients and the above-described distance coefficient, the humidity coefficient, and the ejection time difference coefficient) may be used, or any appropriate combination of the coefficients may be used.

TABLE 7

| Ejection Volume | Ejection Volume Coefficient |
|---|---|
| 5.0 pL | 1.0 |
| 6.0 pL | 1.1 |
| 8.0 pL | 1.2 |

TABLE 8

| Ink Type | Ink Type Coefficient |
|---|---|
| Ink A | 1.1 |
| Ink B | 1.0 |
| Ink C | 0.9 |

Fifth Exemplary Embodiment

Figure 13:
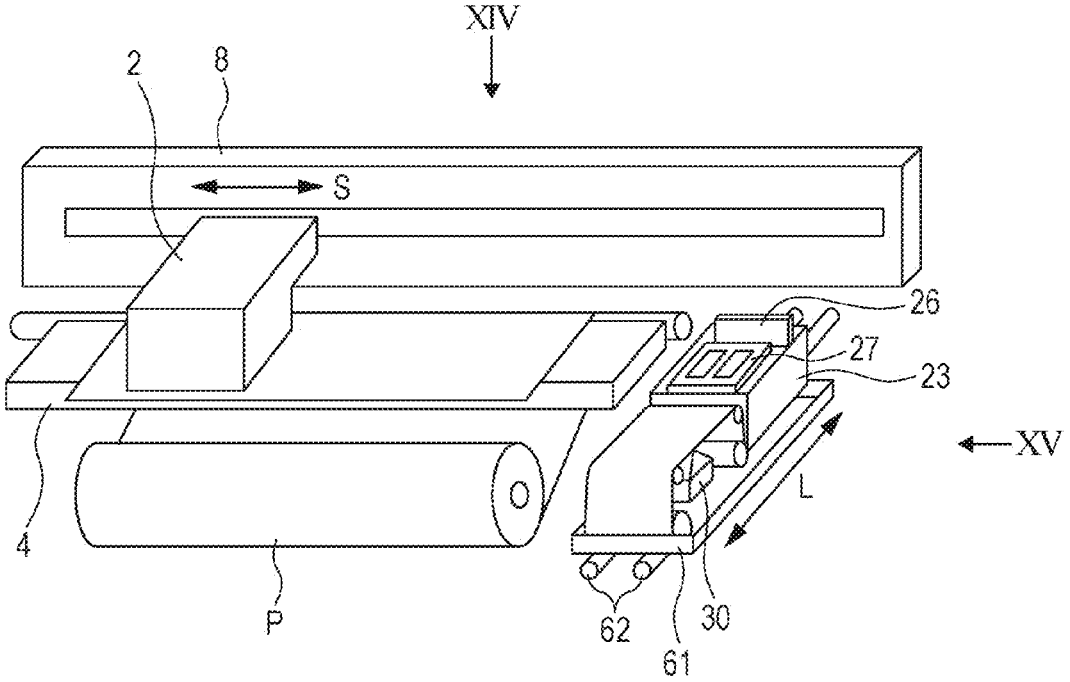
FIG. 13 is a schematic illustration of a recovery unit and a purge unit according to a fifth exemplary embodiment of the present invention.

According to the present exemplary embodiment, a configuration that differs from the configuration described in Section 1-3 with reference to FIG. 1C is described. That is, the configuration according to the present exemplary embodiment differs from the configuration in which the recovery unit 22 is disposed on the home position side and the purge unit 30 is disposed on the back position side. As illustrated in FIG. 13, the recovery unit 22 and the purge unit 30 are disposed on the home position side and are fixed onto a movable table 61. That is, the sheet member 31 is disposed on the side the same as the recovery unit 22 in the main scanning direction S of the print head 9 and is supported by the movable table 61 that is common to the recovery unit 22. The movable table 61 moves along a slide guide 62 in a direction that is perpendicular to the main scanning direction S of the carriage unit 2 (i.e., a conveyance direction L). Accordingly, the purge unit 30 performs a purge operation over the orifice face 19 of the print head 9 in parallel to the nozzle arrays (in the conveyance direction L). The operation is illustrated in FIGS. 14A to 14D and FIGS. 15A to 15E. FIGS. 14A to 14D illustrate the operations performed by the recovery unit 22 and the purge unit 30 viewed in the direction XIV illustrated in FIG. 13, and FIGS. 15A to 15E illustrate the operations viewed in the direction XV illustrated in FIG. 13.

Figure 14A:
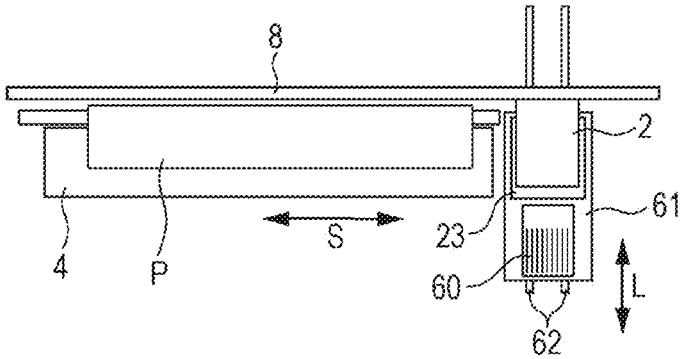
FIGS. 14A to 14D are schematic illustrations of the operation performed by the purge unit according to the fifth exemplary embodiment.
Figure 14B:
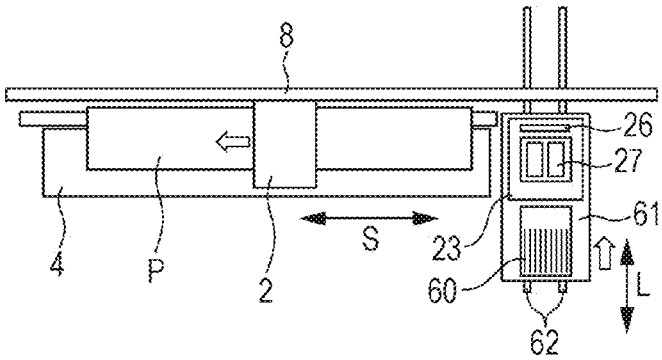
Figure 14C:
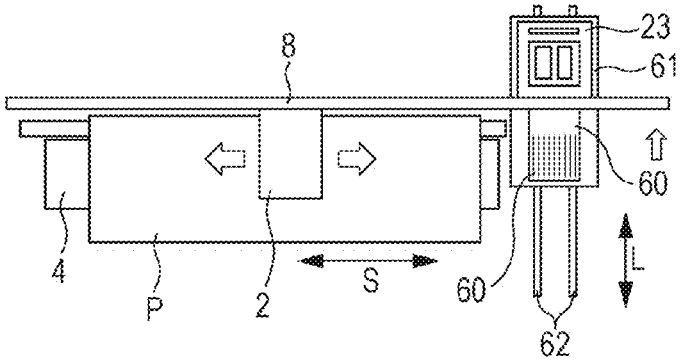
Figure 14D:
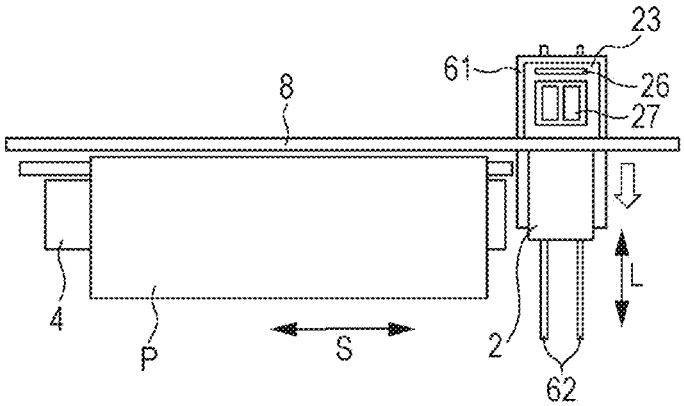

As illustrated in FIG. 14A, before printing begins, the cap 27 is removed from the print head 9 or the carriage unit 2, and the print head 9 and the carriage unit 2 are ready for perform a scanning operation in the main scanning direction S. It is determined whether data needed for one scan has been accumulated in the print buffer 121. If it is determined that data needed for one scan has been accumulated, the carriage unit 2 performs a print operation for one scan by moving from the home position to the back position, as illustrated in FIG. 14B. When the print operation starts, the movable table 61 moves in the conveyance direction L. As illustrated in FIG. 14C, the purge unit 30 is located on the extension line of the platen 4. The recovery unit 22 retracts beneath the guide shaft 8. This operation is performed in order to perform preliminary ejection above the purge unit 30. Thereafter, it is determined whether data needed for one scan has been accumulated in the print buffer 121. If it is determined that data needed for one scan has been accumulated, the carriage unit 2 performs a print operation for one scan by moving from the back position to the home position. Subsequently, a purge operation is performed. More specifically, as illustrated in FIG. 14D, after the print operation is completed, the carriage unit 2 is moved to a position at which the carriage unit 2 faces the purge unit 30. After the carriage is stopped, the purge operation is performed.

Figure 15A:
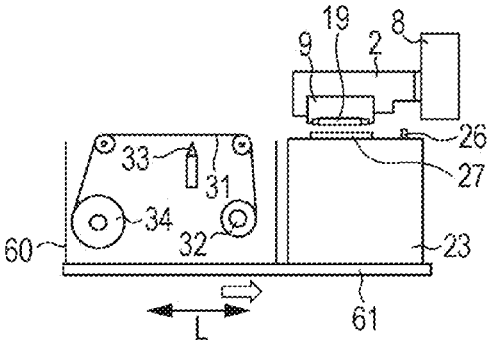
FIGS. 15A to 15E are schematic illustrations of the operation performed by the purge unit according to the fifth exemplary embodiment.
Figure 15D:
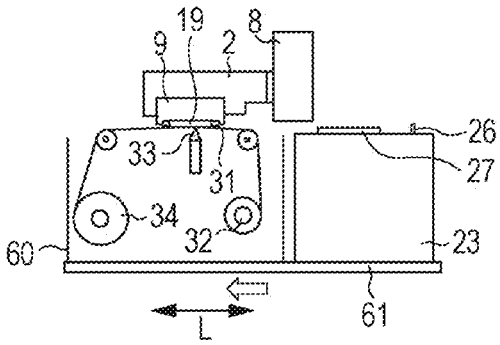
Figure 15B:
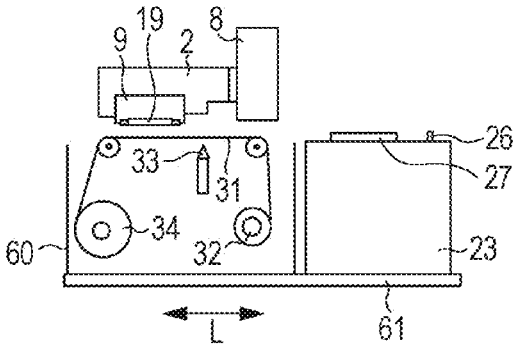
Figure 15E:
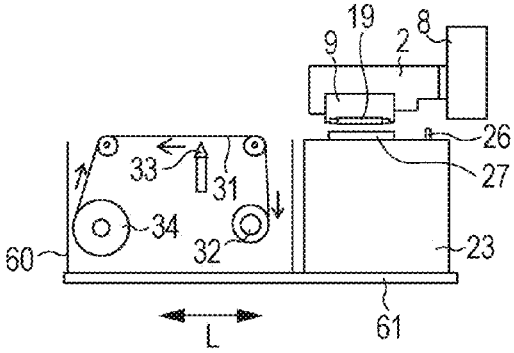
Figure 15C:
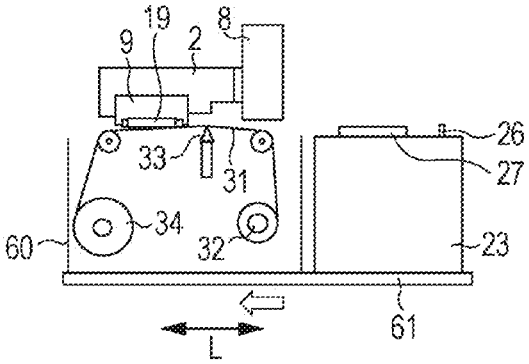

The purge operation is described in more detail below with reference to FIGS. 15A to 15E. FIG. 15A illustrates a condition that is the same as the condition of FIG. 14A, that is, the condition in which the cap is removed and, thus, the print head 9 or the carriage unit 2 is scannable. FIG. 15B illustrates a condition that is the same as the condition of FIG. 14D, that is, the condition in which the carriage unit 2 has moved to the position at which the carriage unit 2 faces the purge unit 30. After the carriage unit 2 stops above the purge unit 30, the pressing member 33 is lifted. As illustrated in FIG. 15C, the pressing member 33 is stopped and maintained at a height of the orifice face 19 of the print head 9. Thereafter, as illustrated in FIG. 15D, the movable table 61 moves in the conveyance direction L and, thus, the orifice face 19 of the print head 9 is slid and scrubbed by the sheet member 31 in a direction parallel to the nozzle arrays. In this manner, purging is performed. At that time, the pressing member 33 is maintained at the height of the orifice face 19 until the print head 9 moves past the pressing member 33. After the purge operation is completed, the pressing member 33 is lowered to the height of the platen 4, as illustrated in FIG. 15E. The winding roller 32 rotates and winds the used part of the sheet member 31 therearound. At the same time, an unused part of the sheet member 31 is fed from the supply roller 34.

Figure 16A:
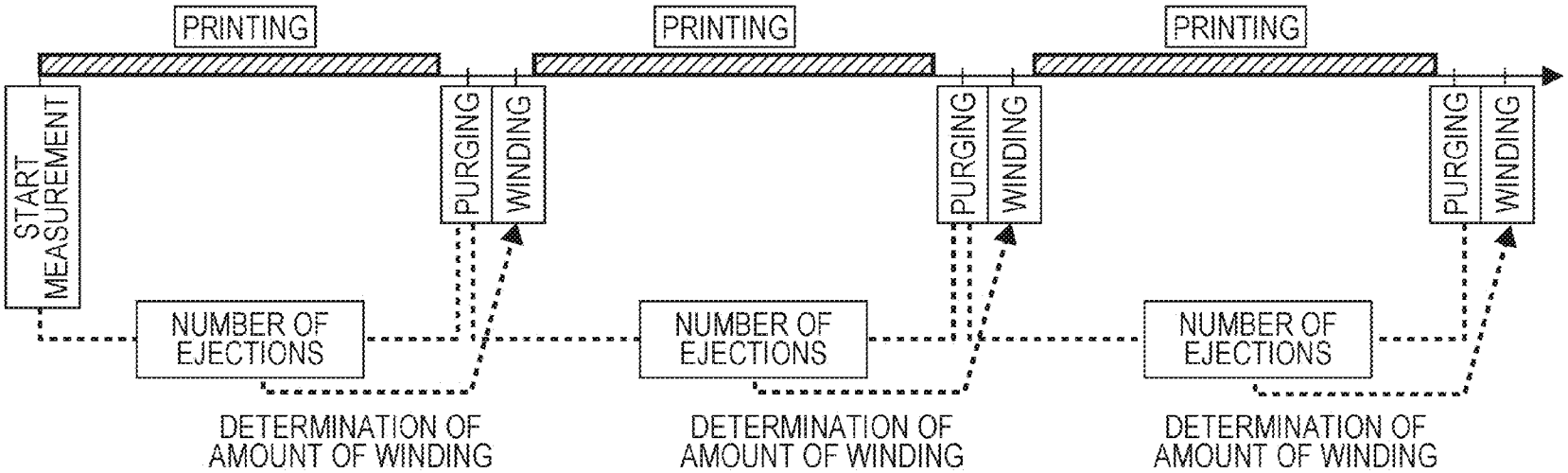
FIGS. 16A and 16B are schematic illustrations of a purge operation sequence according to the first exemplary embodiment.
Figure 16B:
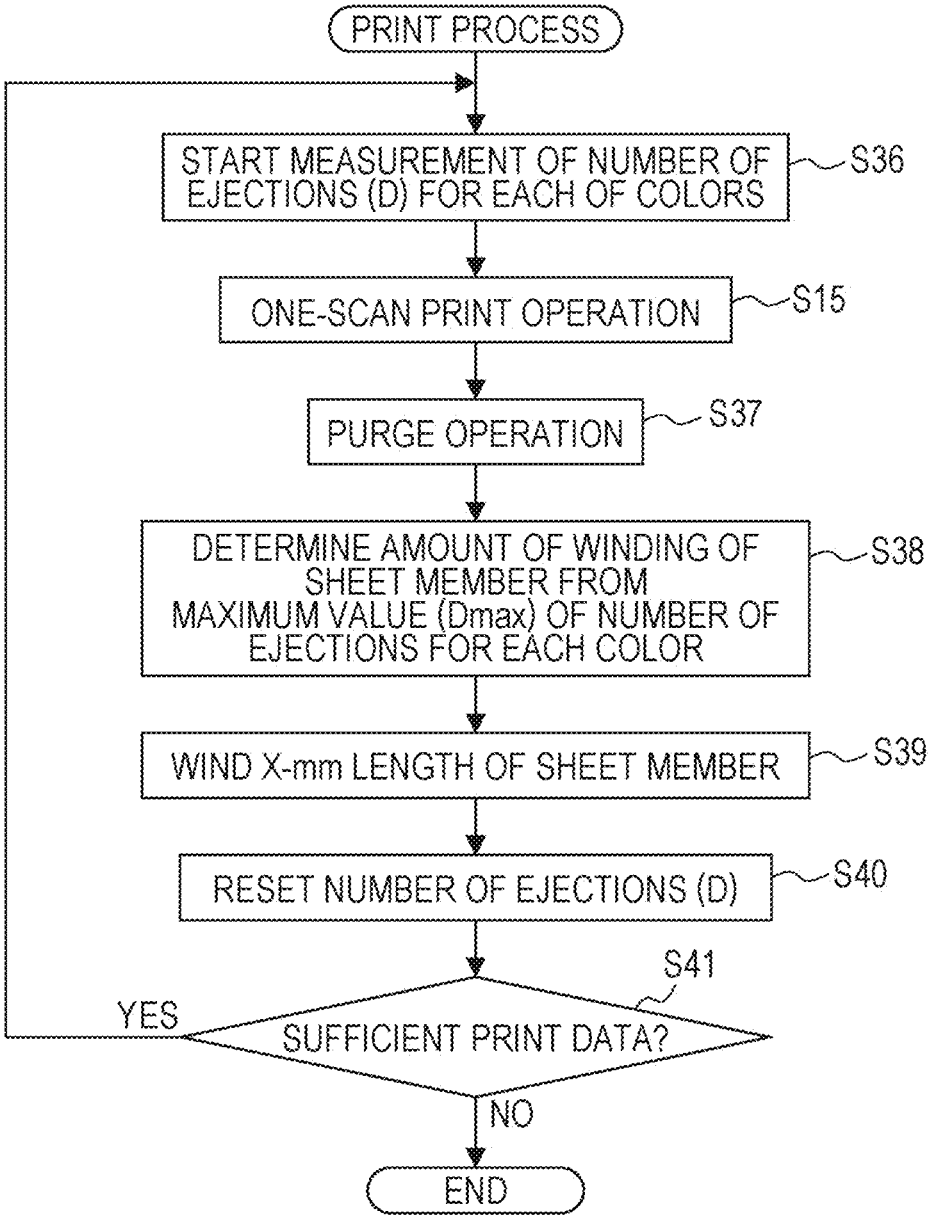

The purge operation performed in the above-described configuration is described in more detail below. According to the present exemplary embodiment, the purge operation is performed for each of back-and-forth scans. A schematic purging sequence (step S14) in the print process illustrated in FIG. 6 and the flowchart of the print process are illustrated in FIGS. 16A and 16B, respectively. After the print process is started and data needed for one scan is accumulated in the print buffer 121, measurement of the number of ink ejections (D) is started for each of the chips 11 to 16 corresponding to different colors (step S36). Immediately after measurement starts, a print operation for one scan is started (step S15).

After the print operation for one scan is completed, a purge operation illustrated in FIGS. 15A to 15D is performed (step S37). Part of the sheet member 31 used in the purge operation is collected through a winding operation illustrated in FIG. 15E (step S39). The amount of winding (X) is determined by computing the maximum value of the number of ejections (Dmax) from the total number of ink ejections (D) performed by each of the chips corresponding to the different colors and measured until the purge operation is performed and selecting a value corresponding to the computed Dmax from Table 9 (step S38). That is, the control unit computes a total number of ejections (D) performed by the nozzles during a predetermined range of the print operation for each of the colors and computes the maximum value from among the total numbers of ejections (D) as the maximum value of the number of ejections (Dmax). When a plurality of the ejection ports are assigned to each of the colors, the total number of ink ejections (D) is computed as a total number of ejections performed by the plurality of the ejection ports for the color. In contrast, when a plurality of nozzle arrays for the same color are disposed in a head, the total number of ink ejections (D) is computed as a total number of ejections performed by each of the nozzle arrays. The control is performed so that the amount of winding (X) increases with increasing number of ejections. This is because the amount of mist increases as the number of ejections increases and, therefore, the amount of mist deposited on the orifice face 19 of the print head 9 increases. If the orifice face 19 having a large amount of mist deposited thereon is cleaned, the purged mist in the wiping trace on the sheet member 31 bleeds. Accordingly, the width of the wiping trace of the sheet member 31 increases. However, by increasing the amount of winding, the whole area in which the mist bleeds can be collected. Thus, the surface of the sheet member after the winding operation is performed can be used as an unused part. In contrast, when the orifice face 19 having only a small amount of mist is purged, the mist in the wiping trace of the sheet member 31 negligibly bleeds and, therefore, the width of the wiping trace is small. Thus, by reducing the amount of winding, excessive winding of the sheet member can be prevented.

Subsequently, the number of ink ejections (D) is reset (step S40). Thereafter, it is determined whether print data is present (step S41). If print data is present, measurement of the number of ejections is started again (step S36), and the above-described process flow is repeated. However, if print data is not present, the print process is completed. As described above, the present exemplary embodiment is characterized in that the number of ejections (D) is measured for each of the ejection ports corresponding to the different colors, the maximum value of the number of ejections (Dmax) is computed from the number of ejections (D) for each of the ejection ports corresponding to the different colors immediately after a purge operation is performed, and a predetermined length of the sheet member 31 equal to the length corresponding to Dmax is wound. Furthermore, according to the present exemplary embodiment, by moving the movable table 61 in the conveyance direction L of the recording medium P, a capping operation and a purge operation for the orifice face can be selectively performed.

TABLE 9

| Maximum Value of Number of Ejections: Dmax | Amount of Winding: X |
|---|---|
| $Dmax < 1 \times 10^6$ | 3 mm |
| $1 \times 10^6 \leq Dmax < 5 \times 10^6$ | 5 mm |
| $5 \times 10^6 \leq Dmax$ | 7 mm |

Example 5

Figure 17A:
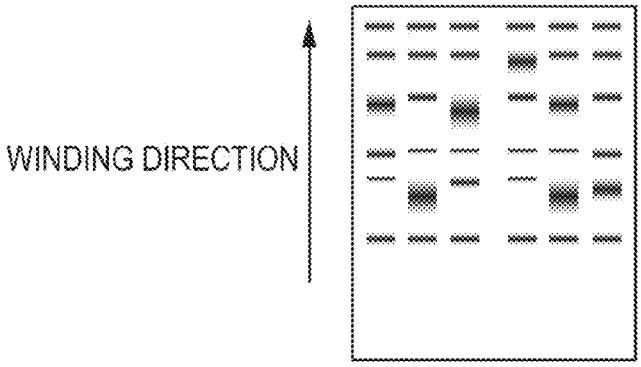
FIGS. 17A to 17C illustrate wiping traces appearing in a sheet member in Example 5 and Comparative examples 5 and 6, respectively.

FIG. 17A illustrates a wiping trace appearing in the sheet member 31 when the sequence illustrated in FIGS. 16A and 16B is performed. In FIG. 17A, the winding direction is indicated by an arrow. Thus, the wiping trace generated in the first purging operation is uppermost. Since the number of ink ejections (D) for each of all colors is less than $1\times10^6$ and, thus, Dmax is less than $1\times10^6$ in each of the first scan, the fourth scan, and sixth scan, the amount of winding is 3 mm, according to Table 9. In addition, since Dmax is greater than or equal to $1\times10^6$ and less than or equal to $5\times10^6$ in the second scan, the amount of winding is 5 mm, according to Table 9. Since Dmax is greater than or equal to $5\times10^6$ in each of the third and fifth scans, the amount of winding is 7 mm, according to Table 9.

Comparative Example 5

Figure 17B:
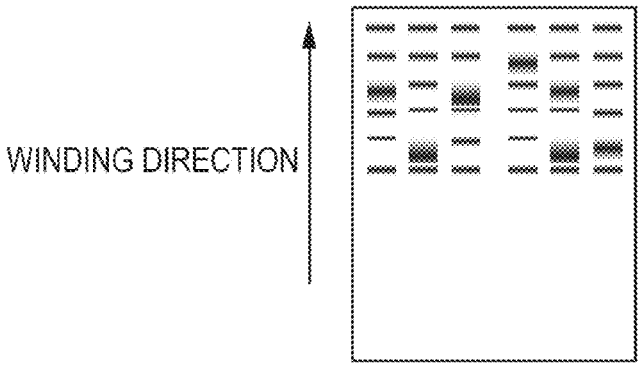

FIG. 17B illustrates a wiping trace appearing in the sheet member 31 when the amount of winding is fixed to 3 mm for each of the scans and a print operation that is similar to that in Example 5 illustrated in FIG. 17A is performed. Since the amount of winding is small after each of the second, third, and fifth scans is completed, the wiping operation for each of third, fourth, and sixth scans starts from used part of the sheet member 31. Therefore, the wiping traces overlap each other.

Comparative Example 6

Figure 17C:
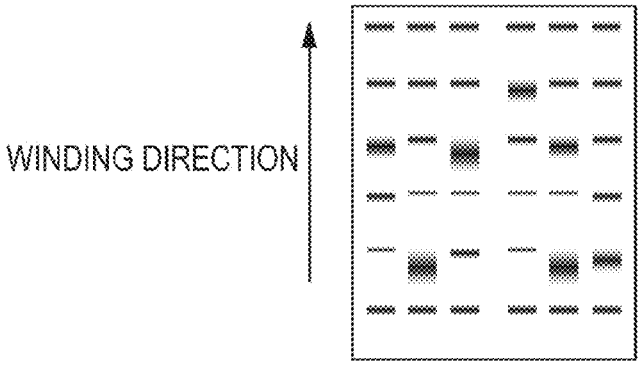

FIG. 17C illustrates a wiping trace appearing in the sheet member 31 when the amount of winding is fixed to 7 mm for each of the scans and a print operation that is similar to that in Example 5 illustrated in FIG. 17A is performed. Since the amount of winding is large after each of the first, second, and fourth scans is completed, the distance between the adjacent wiping traces is large. Therefore, a large unused area appears between the wiping traces.

Table 10 summarizes the results of Example 5 and Comparative examples 5 and 6. In Example 5, the amount of winding is varied in accordance with the maximum value of the number of ejections (Dmax) from the ejection ports corresponding to each color. Accordingly, unlike Comparative example 5 in which the wiping traces on the sheet member 31 overlap each other, the purge performance is not degraded. In addition, the length of the sheet member 31 used can be made smaller than that of Comparative example 6.

TABLE 10

| | Amount of Sheet Member Used | Overlap of Wiping Traces |
|---|---|---|
| Example 5 | 28 mm | No |
| Comparative Example 5 | 18 mm | Yes |
| Comparative Example 6 | 42 mm | No |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-073289 filed Mar. 28, 2012 and No. 2012-275991 filed Dec. 18, 2012, which are hereby incorporated by reference herein in their entirety.

What is claimed is:

1. An inkjet printing apparatus comprising:

a print head having at least one nozzle array disposed in an orifice face, the nozzle array including a plurality of nozzles is arranged in a first direction, the nozzles ejecting ink;

a scanning unit configured to scan the print head in a second direction perpendicular to the first direction;

a purge unit configured to perform a purging operation and including a sheet member configured to contact the orifice face and purge ink deposited on the orifice face a winding unit configured to wind the sheet member thereon; and a control unit configured to control, on the basis of the number of ink ejections from the print head executed between a first purging operation performed by the purge unit and a second purging operation subsequently performed after the first purging operation, an amount of winding of the sheet member by the winding unit after the second purging operation.

2. The inkjet printing apparatus according to claim 1, wherein if a second number of ejections is greater than a first number of ejections, the control unit sets the amount of winding corresponding to the second number of ejections to an amount that is greater than the amount of winding corresponding to the first number of ejections.

3. The inkjet printing apparatus according to claim 1, wherein ink on the orifice face is purged by the sheet member during a period of time when the print head is being scanned by the scanning unit.

4. The inkjet printing apparatus according to claim 3,

Wherein the print head includes a first nozzle array and a second nozzle array, and wherein the control unit controls the amount of winding on the basis of a sum of the number of ink ejections from the first nozzle array and the number of ink ejections from the second nozzle array.

5. The inkjet printing apparatus according to claim 1, further comprising:

a moving unit configured to move the purge unit in the first direction, wherein ink on the orifice face is purged when the scanning unit is stopped in the vicinity of one end portion of the scanning area of the scanning unit by moving the moving unit.

6. The inkjet printing apparatus according to claim 5,

Wherein the print head includes a first nozzle array and a second nozzle array, and wherein the control unit controls the amount of winding on the basis of a larger one of the number of ink ejections from the first nozzle array and the number of ink ejections from the second nozzle array.

7. The inkjet printing apparatus according to claim 1, wherein the control unit multiplies the number of ink ejections by a distance coefficient determined in accordance with a distance between the orifice face of the print head and a recording medium to obtain a value corrected using the distance coefficient and controls the winding unit on the basis of the corrected value.

8. The inkjet printing apparatus according to claim 1, further comprising:

a humidity measuring unit configured to measure a humidity around the inkjet printing apparatus, wherein the control unit multiplies the number of ink ejections by a humidity coefficient determined in accordance with the humidity measured by the humidity measuring unit to obtain a value corrected using the humidity coefficient and controls the winding unit on the basis of the corrected value.

9. The inkjet printing apparatus according to claim 1, wherein the nozzle array is divided into a plurality of blocks each including a plurality of nozzles and driven so as to sequentially eject ink on a block basis, and wherein the control unit multiplies the number of ink ejections by an ejection time difference coefficient determined in accordance with a time difference between ejection times of two adjacent nozzles to obtain a value corrected using the ejection time difference coefficient and controls the amount of winding on the basis of the corrected value.

10. The inkjet printing apparatus according to claim 1, wherein the control unit multiplies the number of ink ejections by an ink ejection volume coefficient determined in accordance with an ink volume ejected from the nozzles per ejection to obtain a value corrected using the ink ejection volume coefficient and controls the amount of winding on the basis of the corrected value.

11. The inkjet printing apparatus according to claim 1, wherein the control unit multiplies the number of ink ejections by an ink type coefficient determined in accordance with the type of ink to obtain a value corrected using the ink type coefficient and controls the amount of winding on the basis of the corrected value.

12. A method for controlling an inkjet printing apparatus, the inkjet printing apparatus including a print head having at least one nozzle array disposed in an orifice face, where the nozzle array includes a plurality of nozzles that is arranged in a first direction and that eject ink, a scanning unit configured to scan the print head in a second direction perpendicular to the first direction, a purge unit configured to perform a purging operation includes a sheet member configured to contact the orifice face and purge ink deposited on the orifice face a winding unit configured to wind the sheet member thereon, the method comprising:

measuring the number of ink ejections from the print head executed between a first purging operation performed by the purge unit and a second purging operation subsequently performed after the first purging operation is performed; and winding a predetermined amount of the sheet member using the winding unit after the second purging operation, the predetermined amount of the sheet member being set on the basis of a result of measuring the number of ink ejections.

* * * * *